US007568859B2

(12) United States Patent
McFarland

(10) Patent No.: US 7,568,859 B2
(45) **Date of Patent: *Aug. 4, 2009**

(54) WAVE FORMING APPARATUS AND METHOD

(75) Inventor: Bruce C. McFarland, Solana Beach, CA (US)

(73) Assignee: American Wave Machines, Inc., Solara Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/958,785

(22) Filed: Dec. 18, 2007

(65) Prior Publication Data

US 2008/0107486 A1 May 8, 2008

Related U.S. Application Data

(63) Continuation of application No. 11/248,380, filed on Oct. 11, 2005, now Pat. No. 7,326,001, which is a continuation-in-part of application No. 11/044,554, filed on Jan. 26, 2005, now abandoned, which is a continuation of application No. 10/372,549, filed on Feb. 24, 2003, now Pat. No. 6,932,541, which is a continuation-in-part of application No. 10/103,600, filed on Mar. 19, 2002, now Pat. No. 6,629,803.

(51) Int. Cl.
*E02B 3/00* (2006.01)

(52) U.S. Cl. ..... 405/79; 472/117

(58) Field of Classification Search ..... 405/79, 405/76; 472/117, 128; 4/491
See application file for complete search history.

(56) References Cited

U.S. PATENT DOCUMENTS 3,350,724 A 11/1967 Leigh
3,802,697 A 4/1974 Le Mehaute
3,913,332 A 10/1975 Forsman
4,142,258 A 3/1979 Schiron
4,954,014 A 9/1990 Sauerbier et al.
5,171,101 A 12/1992 Sauerbier et al.
5,219,315 A 6/1993 Fuller et al.
5,236,280 A 8/1993 Lochtefeld
RE34,402 E 10/1993 Williams
5,271,692 A 12/1993 Lochtefeld (Continued)

FOREIGN PATENT DOCUMENTS

DE 3341083 A1 5/1985

OTHER PUBLICATIONS

Bakhmeteff, Boris A., "Hydraulics of Open Channels", pp. 292-293, McGraw-Hill 1932.

(Continued)

*Primary Examiner*—Frederick L Lagman
(74) *Attorney, Agent, or Firm*—Manuel de la Cerra

(57) ABSTRACT

A wave forming apparatus has a channel for containing a flow of water with an inlet end connected to a water supply, a base, and spaced side walls, a first bed form or weir at the inlet end of the channel, and a second bed form in the channel downstream of the first bed form. Each bed form has an upper portion and a downwardly inclined downstream face extending from the upper portion to a trailing end. The trailing end of at least the first bed form is an extended, horizontal tail portion which extends up to an upwardly inclined leading face of the second bed form.

36 Claims, 18 Drawing Sheets

U.S. PATENT DOCUMENTS

| | | | | |
|---|---|---|---|---|
| 5,342,145 | A | 8/1994 | Cohen | |
| 5,401,117 | A | 3/1995 | Lochtefeld | |
| 5,421,782 | A | 6/1995 | Lochtefeld | |
| 5,453,054 | A | 9/1995 | Langford et al. | |
| 5,564,859 | A | 10/1996 | Lochtefeld | |
| 5,667,445 | A | 9/1997 | Lochtefeld | |
| 5,766,082 | A | 6/1998 | Lochtefeld et al. | |
| 5,913,636 | A | 6/1999 | Macaulay | |
| 6,019,547 | A * | 2/2000 | Hill | 405/79 |
| 6,132,317 | A | 10/2000 | Lochtefeld | |
| 6,336,771 | B1 | 1/2002 | Hill | |
| 6,460,201 | B1 | 10/2002 | Lochtefeld | |
| 6,491,589 | B1 | 12/2002 | Lochtefeld | |
| 6,629,803 | B1 * | 10/2003 | McFarland | 405/79 |
| 6,932,541 | B2 * | 8/2005 | McFarland | 405/79 |
| 7,326,001 | B2 * | 2/2008 | McFarland | 405/79 |
| 2002/0056157 | A1 | 5/2002 | Lochtefeld | |

OTHER PUBLICATIONS

Michael Paine "Hydrodynamics of Surfboards" pp. 30 to 35, Thesis, University of Sydney, 1974, http://www4.tpg.com.au/users/mpaine/thesis.html.

River Surfing in Munich, pp. 1 and 2, Eisbach Artificial River, http://www.toytowngermany.com/lofi/index.php/t73618-0.html.

* cited by examiner

WAVE FORMING APPARATUS AND METHOD

RELATED APPLICATION

The present application is a Continuation of application Ser. No. 11/248,380 filed Oct. 11, 2005, now U.S. Pat. No. 7,326,001 which was a Continuation-In-Part of application Ser. No. 11/044,554 filed Jan. 26, 2005 (abandoned), which was a Continuation of application Ser. No. 10/372,549 filed Feb. 24, 2003, now U.S. Pat. No. 6,932,541, which was a Continuation-In-Part of application Ser. No. 10/103,600 filed Mar. 19, 2002, now U.S. Pat. No. 6,629,803, the contents of each of which is incorporated herein by reference in its entirety.

BACKGROUND

1. Field of the Invention

The present invention relates generally to a wave forming apparatus and is partially concerned with water rides of the type provided in water-based amusement parks, particularly a wave forming apparatus and method for forming surfable waves, or a water toy.

2. Related Art

Naturally occurring waves occur in the ocean and also in rivers. These waves are of various types, such as moving waves which may be of various shapes, including tubular and other breaking waves. A relatively rare type of wave in nature is the standing wave, which has a steep, unbroken and stable wave face. This type of wave can have enough power and velocity to support surfing on the wave face without causing the wave to decay rapidly. This wave, if forced to decay, for example by overly obstructing the flow, reforms naturally when the obstructions are removed. Natural standing waves have been shown to occur where water flows across natural river bed formations, known as anti-dunes. Upon flow over anti-dunes, the water flow rises into a natural standing wave. Natural standing waves occur in the Waimea Bay river mouth of the Waimea River on the Hawaiian island of Oahu, on the Snake River in Wyoming, and several other places.

Surfers are constantly searching for good surfing waves, such as tubular breaking waves and standing waves. There are only a few locations in the world where such waves are formed naturally on a consistent basis. Thus, there have been many attempts in the past to create artificial waves of various types for surfing in controlled environments such as water parks. In some cases, a sheet flow of water is directed over an inclined surface of the desired wave shape. Therefore, rather than creating a stand-alone wave in the water, the inclined surface defines the wave shape and the rider surfs on a thin sheet of water flowing over the surface. This type of apparatus is described, for example, in U.S. Pat. Nos. 5,564,859 and 6,132,317 of Lochtefeld. In some cases, the inclined surface is shaped to cause a tubular form wave. Sheet flow wave simulating devices have some disadvantages. For example, since these systems create a fast moving, thin sheet of water, they produce a different surfing experience to a real standing wave.

In other prior art wave forming devices, a wave is actually simulated in the water itself, rather than being defined by a surface over which a thin sheet of water flows. U.S. Pat. No. 6,019,547 of Hill describes a wave forming apparatus which attempts to simulate natural antidune formations in order to create waves. A water-shaping airfoil is disposed within a flume containing a flow of water, and a wave-forming ramp is positioned downstream of the airfoil structure. In other prior art arrangements, such as U.S. Pat. No. 3,913,332 of Forsman, a wave generator is driven around a circular body of water in order to create waves. This arrangement is also complex and will produce traveling waves, not standing waves.

SUMMARY

According to one aspect, a wave forming apparatus is provided, which comprises a channel for containing a flow of water, the channel having an inlet end connected to a water supply, a base, and spaced side walls, a first or weir bed form in the base at the inlet end of the channel, and at least one second bed form in the channel downstream of the first bed form, each bed form having an upper portion and a trailing end, and a downwardly inclined downstream face extending from the upper portion to the trailing end, the bed forms each extending outwardly to the side walls to define a primary water flow path from the inlet over the bed forms, and at least the trailing end of the first bed form having a first, curved portion transitioning to a second, substantially horizontal tail portion.

In one embodiment, this arrangement creates a standing wave at the leading end of the second bed form and any subsequent bed form for flow rates within a critical range. A standing wave is a wave which tends to hold its shape and not travel over an extended period of time.

Although the apparatus produces stable standing waves when the flow rate of water through the channel is in a critical range, the flow rate may be adjusted if desired, in order to produce different types of waves. The following are definitions of some of the terms used herein:

A standing wave is a raised, rideable water shape that substantially holds its position without traveling or breaking over an extended period of time.

A curling wave is a wave which is breaking at one end of the wave peak and which transitions to a smooth, non-breaking wave face away from the breaking end.

A breaking roller is a wave which is collapsing across the entire width of the wave peak.

A tapered stream wave is a raised water shape formed in a gradually varied flow where the velocity and thickness of the water above the bed are changing but do not form a hydraulic jump.

Froude number is defined by the relationship velocity/$\sqrt{(g.d)}$ where g is the standard acceleration due to gravity and d is the depth of the water.

The bed form is raised formation in the channel. The length of the substantially horizontal tail portion may be of the order of 25% to 50% of the total length of the bed form. The length of this portion may be approximately equal to that of a surfboard. This extension of the tail of the bed form improves the wave by allowing room for longer surfboards to maneuver in front of the face of the wave.

In one embodiment, an upwardly extending spoiler or abrupt rise is provided on the tail portion of the first bed form. The spoiler may be positioned at a location on the tail portion which is closer to the upstream face of the second bed form than the first bed form. Almost any shape of spoiler can form higher waves for the same water flow rate and allows waves to form over a wider range of water flow rates and Froude numbers than a bed form without a tail end spoiler. The key factors in determining the wave height enhancement are the overall height of the spoiler relative to the height of the bed form peak, as well as the relatively abrupt transition upward from the horizontal tail. The spoiler height may be in the range from 5% to 30% of the height of the bed form peak. In one embodiment, the spoiler has in inclined leading face and a substantially vertical downstream face, and may be associated with a grating in the channel at or adjacent the downstream face of the spoiler, in one embodiment.

The spoiler may be adjustable in height, and may have independently adjustable segments. The spoiler may extend straight across the tail, but in an alternative arrangement it may be curved, beginning upstream of the tail on one side of the bed form and blending into the standard spoiler shape at the end of the tail on the opposite side. This creates a current of water running from the upstream end of the spoiler towards the downstream end of the spoiler, creating a peak wave offset from the centerline of the bed form. This standing wave has a component of flow moving laterally towards the peak which creates a unique wave riding experience of predominantly angled riding. This is also a key component for creating the curling or tubing wave. Reduction in flow rate creates different types of waves. If the spoiler is removed, other types of wave can be created at various flow rates.

In one embodiment, a series of identical bed forms are provided at spaced intervals along the channel, so that a series of standing waves may be formed. The channel cross section may be deeper in the wave forming area than at the outer sides of the bed forms, and may have gradually outwardly sloping side walls. This tends to return water to the center of the flume or channel, and also can help to prevent too much water from escaping around the sides of the bed forms.

The apparatus may be modified in order to create a standing curling wave or tubing wave. In one embodiment, an oblique shaped bed form is positioned in the channel at a position where a standing curling wave is desired. This gives the water a sideways velocity component that induces the more downstream side to break continuously while the more upstream side remains an unbroken standing curl. Alternatively, another channel may intersect the end of the primary channel at an oblique angle, with a deeper river flow along the secondary channel. A curling wave is created at the confluence of the faster, primary channel or flume flow and the deeper river flow.

This wave generating apparatus and method is particularly suitable for use in water park rides and the like and is able to produce standing waves over a wider range of flow rates than was possible in the past. The waves are relatively stable, enabling surfers to ride for a longer period of time without the wave decaying. Various parameters of the apparatus may be adjusted if desired, to produce different types of waves, such as breaking rollers or tapered stream waves.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for a wave generating apparatus.

After reading this description it will become apparent to one skilled in the art how to implement the invention in various alternative embodiments and alternative applications. However, although various embodiments of the present invention will be described herein, it is understood that these embodiments are presented by way of example only, and not limitation.

Figure 1:
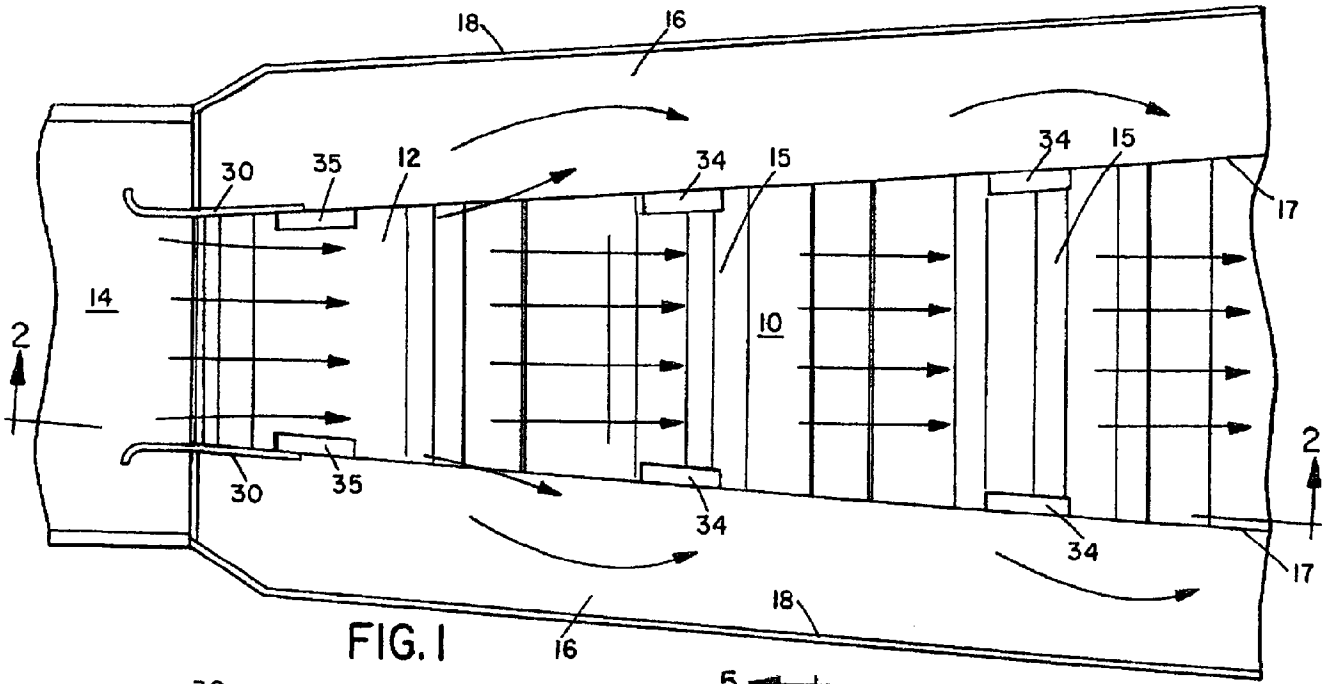
FIG. 1 is a top plan view of a wave forming apparatus according to a first exemplary embodiment.
Figure 2:
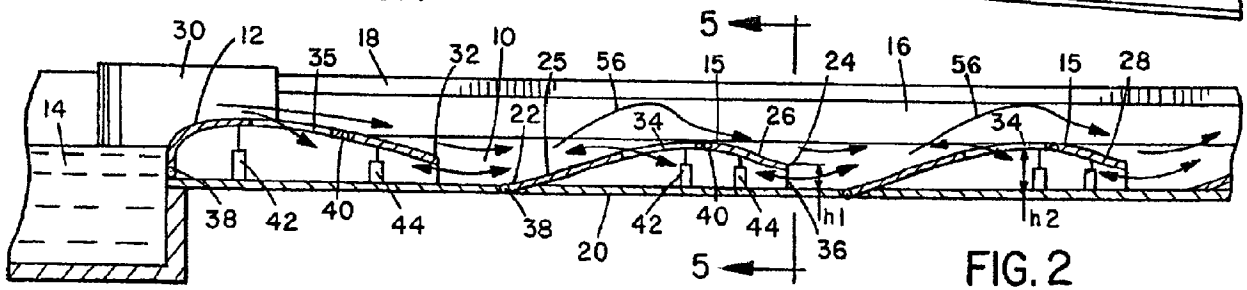
FIG. 2 is a sectional view taken along lines 2-2 of FIG. 1, showing the basic water flow.
Figure 5:
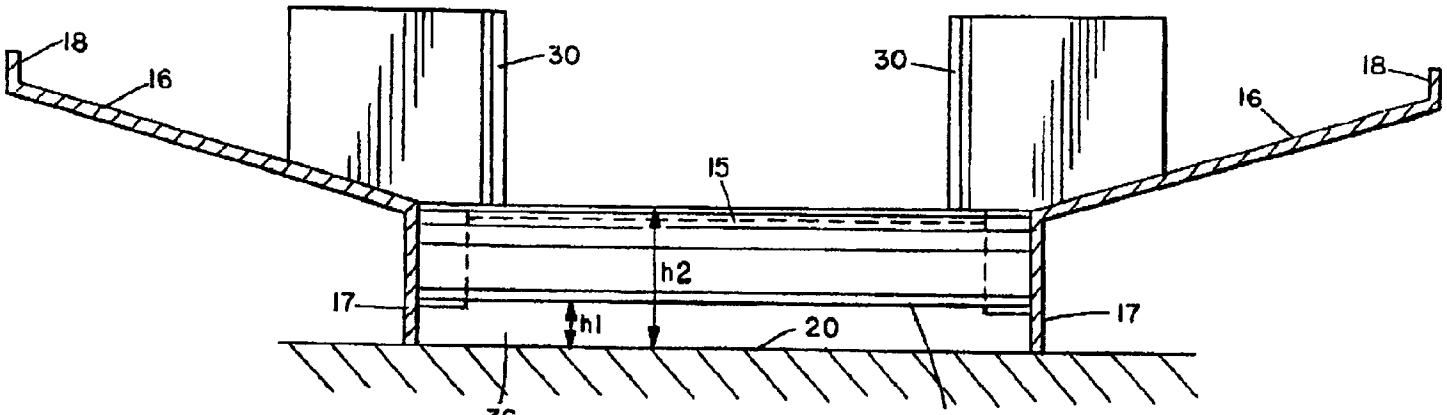
FIG. 5 is an enlarged sectional view taken on lines 5-5 of FIG. 2.

FIGS. 1, 2 and 5 illustrate a wave forming apparatus according to a first embodiment for forming rideable, standing waves. The apparatus basically comprises a channel 10 for containing a flow of water, the channel having a weir 12 at its inlet end connected to a supply of water in a reservoir 14, and a series of spaced bed forms 15 in the channel downstream of the weir. Sloping side walls or entry/exit portions 16 extend outwardly from opposite sides 17 of the wave forming channel 10 to the outer sides 18 of the apparatus, which are spaced outwardly from the outer sides of channel 10, as best illustrated in FIGS. 1 and 5.

As best illustrated in FIG. 2, the channel 10 has a base or lower wall 20 and the weir 12 and bed forms 15 are provided at spaced intervals along the channel, mounted in the base of the channel and extending between the opposite side walls of the channel, to define a primary flow path for water over the weir and the bed forms. In the embodiment of FIGS. 1, 2 and 5, the opposite sides 17 of the channel 10 are shown to taper outwardly from the inlet end of the channel, at weir 12, to the opposite end of the channel. However, the sides 17 may alternatively be straight, as in the embodiment of FIGS. 15 and 16, discussed in more detail below, or taper inwardly.

The bed forms 15 are each of similar or identical shape and have a leading end 22 and a trailing end 24, with an upstream face 25 inclined upwardly to a peak or upper portion, and a downstream face 26 with a downwardly inclined, convex curvature extending from the peak towards the trailing end 24. As best illustrated in FIG. 2, the upstream end 22 is flush with the base 20 of the channel, for improved safety. The downstream face has a re-curve or change in curvature adjacent the trailing end, such that it terminates in a generally flat or horizontal portion 28. The trailing end 24 is spaced above the base 20 of the channel to form an abrupt vertical cut-off, as indicated in FIG. 2. The tail elevation factor TEF, or ratio of the height h1 of the trailing end 24 of the bed form above the base of the channel to the height h2 at the top or peak of the next bed form is designed to be in a predetermined range which has been found to produce standing waves. The range in TEF may be in the range from 0.125 to 0.75 while still producing rideable standing waves.

The weir 12 also extends upwardly from the base, with a trailing end at the inlet from reservoir 14. Spaced inlet side walls 30 extend from a location in reservoir 14 outwardly along opposite sides of weir 12. This has been found to smooth the water flow from the reservoir into the channel 10. The weir 12 is of an airfoil like shape, extending upwardly from the leading edge to a peak and then having a convex downward curvature up to trailing edge 32, which is also spaced above the base 20 of the channel.

In the embodiment of FIG. 2, the weir and bed forms 12 and 15 may be of any suitable sheet material construction, such as metal, strong plastic material, or thin concrete and have a hollow interior. The bed forms each have a pair of elongate side vents 34 along opposite sides of the bed form extending across the peak of the bed form, as best illustrated in FIGS. 1 and 2. Similarly, the weir 12 has a pair of elongate side vents 35 on its opposite sides, extending along part of the downwardly inclined face. The raised trailing ends of the weir and bed forms also each form a vent 36 extending across the width of the channel, which defines, together with side vents 34, a secondary flow path for water traveling along channel 10.

The weir and bed form may each be supported by pedestals under or adjacent the peak or highest point of the bed form, such as pedestals 42 as illustrated in FIG. 2. Shorter pedestals 44 are provided to support the tail end portion of the weir and bed forms. The pedestals 42 and 44 are adjustable in height, with the opposite sides of the weir and bed forms sliding against the channel side walls 17. In an exemplary embodiment, two spaced pedestals 42 and two spaced pedestals 44 are provided, with each pedestal being approximately one quarter of the bed form width inwardly from the adjacent side wall 17, and spaced apart from the other pedestal by a distance equal to half the bed form width. A greater number of pedestals may be provided if required for additional support.

In order to provide adjustability in the secondary flow, the adjustable pedestals or hydraulic rams 42 and 44 provide height adjusters for varying the bed form and tail elevation. In the illustrated embodiment, the weir and bed forms are each secured to the channel base at the leading end via a first pivot 38, and a trailing end portion of the weir and bed forms is formed as a separate section pivoted to the remainder at a second pivot 40. The first pedestal or hydraulic ram 42 acts between the base of the channel and the upstream pivoted portion of the weir and bed form, and the second pedestal or hydraulic ram 44 acts between the base of the channel and the pivoted trailing end portion of the weir and bed forms. The first height adjuster 42 changes the height of the peak of the weir or bed form, while the second height adjuster changes the elevation of the tail end of the weir or bed form, thus changing the vent height and the amount of secondary flow into or out of the tail end vent. The two pedestals can therefore be adjusted to vary the TEF ratio.

Figure 8:
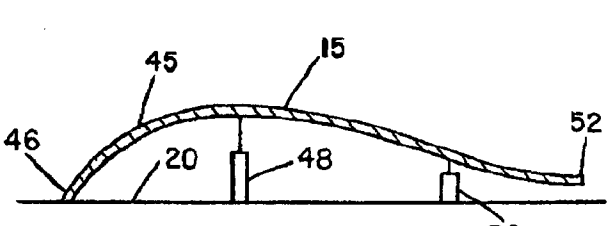
FIG. 8 is a sectional view illustrating another modified bed form with vent height adjustability.
Figure 9:
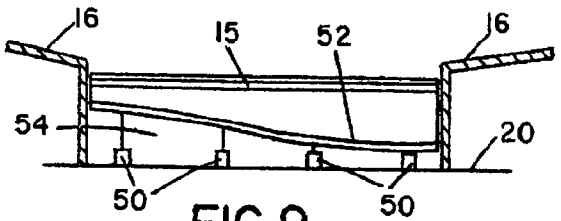
FIG. 9 is an end view of the bed form of FIG. 8, illustrating the height adjusters across the width of the vent.

FIGS. 8 and 9 illustrate a modified height adjustment mechanism for a bed form 15. In this case, rather than pivoted sections, each bed form is a hollow shell 45 formed from a flexible material and secured to the base 20 of the channel at the leading end 46 only. A first series of spaced height adjusters or hydraulic rams 48 extend at spaced intervals across the channel between the base of the channel and the inner surface of the shell 45 adjacent the peak of the bed form. A second series of spaced height adjusters or hydraulic rams 50 extend at spaced intervals across the width of the bed form adjacent the trailing end 52. Thus, the height adjusters 50 can be extended by different amounts, as in FIG. 9, in order to vary the height of the secondary passageway vent 54 across the width of the channel, to vary the standing wave properties. Useful waves can be created with different elevations across the width of the tail, for example one side may be at TEF=0 and the other side at TEF=0.8. This still creates a rideable wave. If the rams 50 are eliminated, the tail end of the bed form in FIG. 8 is self-adjusting in height. This creates an oscillating wave which may be desirable in some cases.

Although the embodiments of FIGS. 1, 2 and 5 and FIGS. 8 and 9 have both weirs and bed forms with height adjustment devices, the apparatus may alternatively have fixed weirs, without any height adjusters, combined with adjustable bed forms, or may have both fixed weirs and fixed bed forms of the same general shape illustrated in the drawings. The adjustability is provided as a means for the operator to vary the wave conditions as desired. However, this may not be necessary in all cases. In general, the height h2 of the peak of the bed form is in the range of half of the inner flume height to 1½ times the inner flume height. In FIG. 5, the bed form height is approximately equal to the inner flume height. The inner flume height is dependent on the application requirements, and in one embodiment of a water park attraction the flume height may be around ⅙ of the width of the flume.

In the apparatus illustrated in FIGS. 1, 2 and 5 and the alternative of FIGS. 8 and 9, water flows from the reservoir in a primary flow path over the top of weir 12 and over each of the successive bed forms. At the same time, as indicated by the arrows 55, a secondary flow path is provided via the side vents and trailing end vents of the weir and bed forms. This secondary flow may be in either direction, i.e. from the trailing end back under the bed form and out at the peak of the bed form, or vice versa, depending on overall flow conditions. The provision of a secondary flow passageway through the bed form with a vent at the trailing edge of the bed form has been found to produce a stable standing wave 56 at the upstream face of the next bed form in the channel, as indicated in FIG. 2. The standing wave formation is enhanced by the provision of the shallow sloping side wall portions 16, which provide for some flow outside channel 10, as indicated in FIG. 1. In general, it is desirable that the flume be deeper in the channel or wave forming area 10 that contains the bed forms, and shallower just beyond the sides of the bed forms. This channels the water over the bed forms, and prevents too much water from escaping around the bed forms, while allowing the sides of the top portion of the standing wave to vent sideways. This is believed to help prevent the standing wave from decaying. The slight upward inclination out to the opposite sides 18 of the apparatus also helps to return water towards the center of the channel, helping additional wave formation at subsequent downstream bed forms.

Figure 17:
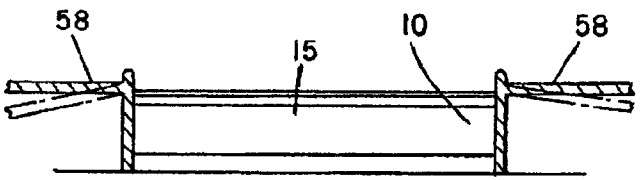
FIG. 17 is a sectional view similar to FIG. 5, but on a reduced scale, illustrating alternative side portions at opposite sides of the wave forming channel.

Although the opposite side portions 16 extending from opposite sides of the channel 10 and bed forms out to the outer sides 18 of the wave forming apparatus are shown in FIG. 5 as having a slight upward slope, they may alternatively be flat or even have a slight downward slope, as indicated in FIG. 17.

FIG. 17 is a view similar to FIG. 5 of a modified flume structure in which flat, shallow outer side portions 58 are provided on opposite sides of the channel. The side portions 58 may alternatively be inclined slightly downwardly, as indicated in dotted outline. It has been found that the side portions 16 or 58 may have an inclination in the range from −5 degrees up to +10 degrees. Any angle in this range has the desired effect of standing wave formation under the proper flow conditions, although an inclination above 0 degrees has the advantage of returning water back into the channel downstream of a first standing wave. In one embodiment, each side portion 16, 58 has a width equal to at least 33% of the channel width for optimum wave sustaining effect. If the side portions are of different widths, one side may have a width of 25% of the channel width if the other side is wider.

The reservoir 14 is continuously supplied with water via a suitable water-recirculating system of a type well known in the field of water park rides, in which water leaving the end of channel 10 is pumped back into the reservoir. The water re-circulation path may be beneath the channel 10, around one or both sides of the channel, or from other adjacent, linked rides.

The combination of features in FIG. 2, i.e. the specific bed form shape, the secondary passageways, and the shallow outer side portions 16, has been found on testing to lead to stable standing wave formation. This, in turn, produces a wave riding water ride suitable for a water amusement park. The shallow outer side portions 16 also provide a convenient means for a rider to enter and exit the ride. The side vents 34, 35 and end vents 36 are covered with gratings (not illustrated) for rider safety. The standing wave 56 in one embodiment has a steep, unbroken, and stable wave face which is good for surfing. Variation of the trailing end vent height across the width of the bed form, as in FIG. 9, may be used, if desired, to create effects such as a sideways breaking wave. The height adjusters 42, 44 may be adjusted to produce a desired sequence of standing, stable waves.

Figure 3:
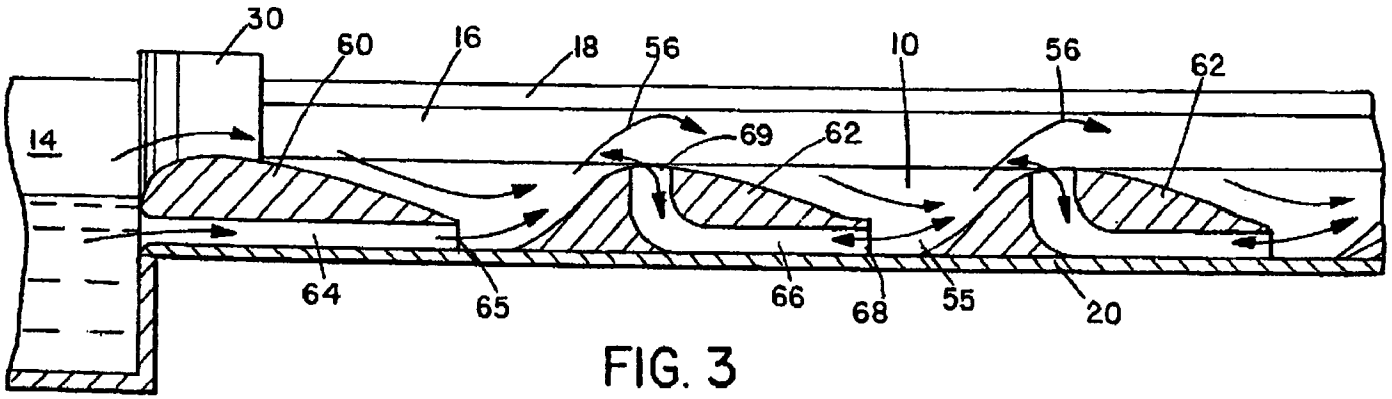
FIG. 3 is a sectional view similar to FIG. 2, showing a modified apparatus.

The weir and bed forms of FIGS. 2 and 8 are hollow shells which provide the secondary passageways back under the shell via suitable venting. Although the vents 34, 35 are spaced side vents in the illustrated embodiment, a vent extending across the top of the bed form may alternatively be provided. However, side vents avoid the need for a safety grating across the entire top of the bed form. Additionally, instead of forming the weir and bed forms by separate shaped sheet-like members secured in the channel, they may alternatively be formed or molded integrally in the base of the channel as solid structures. FIG. 3 illustrates a modified wave forming apparatus according to another embodiment, in which the hollow shell weir and bed forms are replaced with a solid weir 60 and solid bed forms 62 spaced downstream of weir 60. The remainder of the apparatus, apart from the weir and bed forms, is identical to that of FIGS. 1 and 2, and like reference numerals have been used for like parts as appropriate.

The weir 60 is of identical surface shape to the hollow weir 12 of FIG. 2, but has a passageway 64 extending under the weir from the leading end to the trailing end 65, instead of the vent structure of FIG. 2. The bed forms 62 are also of identical shape to the bed forms 15 of FIG. 1, but the vent openings 34, 36 are replaced with passageways 66 through the bed forms. Each passageway 66 has one end opening 68 at the trailing end of the bed form, and another end opening 69 adjacent the peak of the bed form. Two openings 69 may be provided on opposite sides of bed form 62, with two spaced passageways 66 ending in a chamber extending across the width of the bed form and terminating at opening 68. Alternatively, a single opening 69 and passageway 66 may be provided. This arrangement produces standing waves under appropriate flow conditions in an identical manner to the previous embodiment.

Figure 4:
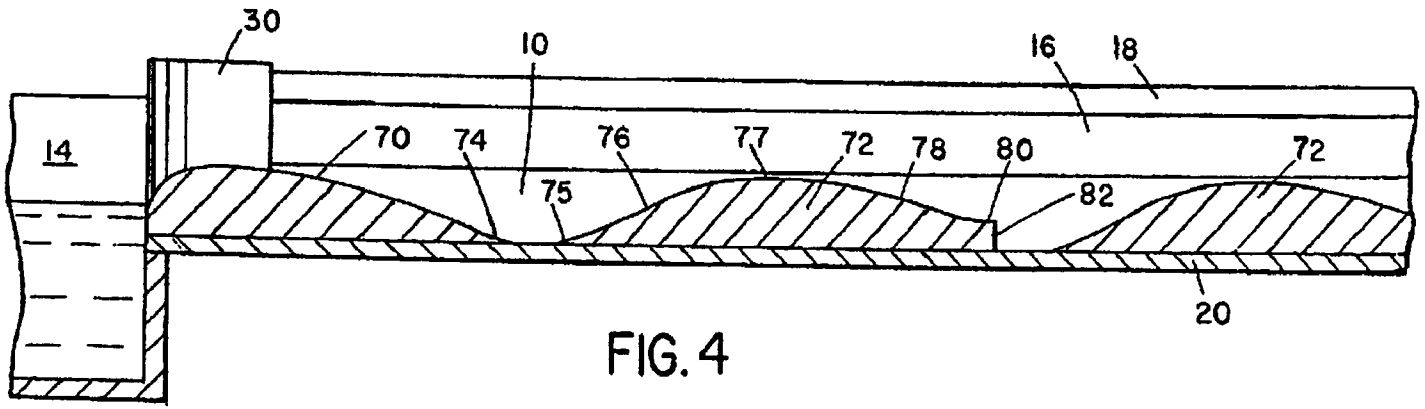
FIG. 4 is a sectional view similar to FIGS. 1 and 2 illustrating another embodiment of the wave forming apparatus.

FIG. 4 illustrates another modified embodiment, which has a similar solid weir and bed form arrangement to FIG. 3, but the secondary flow passageways are eliminated altogether. The structure in FIG. 4 is again identical to that of FIGS. 1 and 2, apart from the weir and bed forms, and like reference numerals are used for like parts as appropriate. In FIG. 4, a weir 70 is provided at the inlet end of channel 10 adjacent the reservoir outlet and a series of spaced, solid bed forms 72 of identical shape are provided along channel 10 downstream of the weir. The weir 70 is of similar, airfoil shape to the weir 60 of FIG. 4, but rather than having an abrupt vertical cut off at the trailing edge, the trailing edge 74 of weir 70 continues to curve downwardly to meet the floor or base 20 of the channel at a smooth transition.

The bed forms 72 are of similar or identical shape to the bed forms 15 and 52 of the previous embodiments, with a leading edge 75 which has a flush transition with the base 20 of the channel, an upwardly inclined leading face 76, a peak 77, a downwardly inclined, concave trailing face 78, and a recurved, substantially flat trailing end portion 80 with an abrupt vertical drop off face 82 at the trailing end of the bed form. It has been found that an abrupt drop off, such as vertical face 82 or the trailing end drop offs of FIGS. 2 and 3, helps to create a stable standing wave at the leading face of the next bed form. This effect occurs in this embodiment without the secondary flow passageways.

Figure 6:
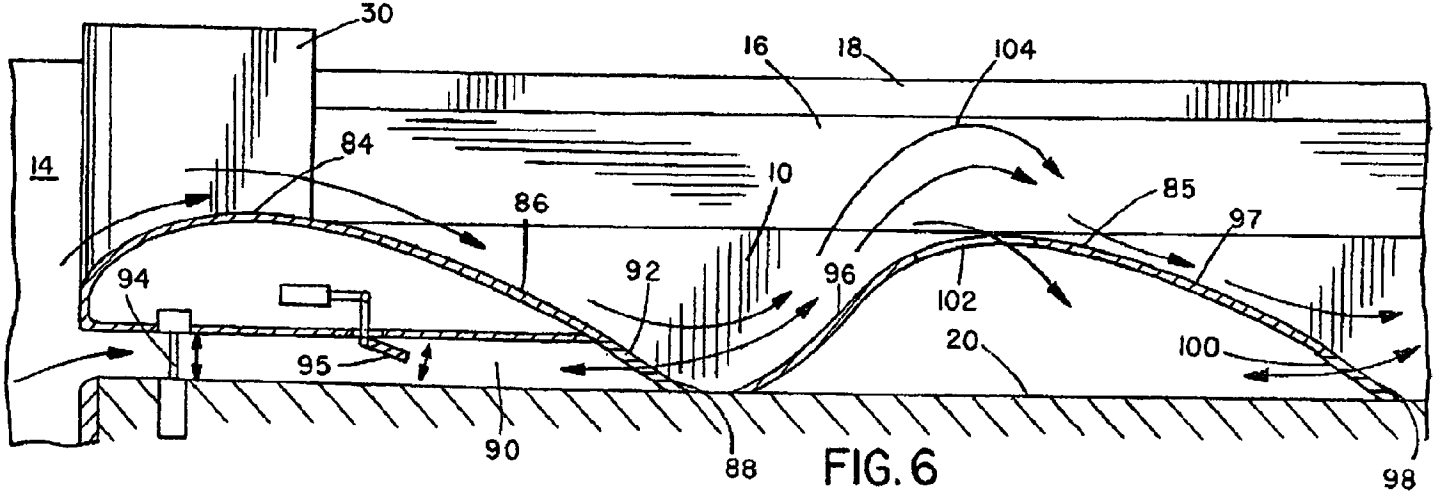
FIG. 6 is an enlarged sectional view similar to FIG. 2 illustrating another embodiment of a wave forming apparatus, with flow control mechanisms.

In the embodiments of FIGS. 1 to 5, the bed forms each have an abrupt trailing edge vertical drop off, with the trailing end of the bed form raised above the channel by a predetermined height, either with or without secondary flow paths for water through the bed form. FIG. 6 illustrates another alternative embodiment which has secondary water flow passageways, but no vertical drop off at the trailing edge of the weir or bed forms. Other parts of the wave forming apparatus are otherwise identical to the previous embodiments, and like reference numerals have been used as appropriate.

In the embodiment of FIG. 6, the channel 10 has a shaped weir 84 at the entry or reservoir end, and one or more bed forms 85 at spaced intervals downstream of weir 84. The weir and bed forms are of hollow shell construction, as in FIGS. 1 and 2, but may alternatively be of solid construction with formed passageways, as in FIG. 3. The weir is of generally airfoil like shape, and has a curved, convex trailing face 86 which extends down to merge smoothly with the base 20 of the channel at its trailing end 88. A secondary passageway 90 extends from reservoir 14 through the lower part of the weir up to the trailing end 88, with a safety grating 92 covering the open, trailing end of passageway 90. The passageway 90 may be provided with one or more flow control devices, such as height adjuster or hydraulic ram 94 and flap valve 95. The adjustable weir 84 of FIG. 6 may used in place of weir 12 of FIG. 2, or in any of the other embodiments to provide added adjustability of water flow at the leading end of the channel.

The bed form 85 has a shape similar to bed form 15 of FIG. 1, with a generally concave, upwardly inclined leading face 96 leading up to a peak, and a downwardly inclined, generally convex trailing face 97. However, the shape at the trailing end is different from the previous embodiments, since the trailing end cut off is eliminated, and the trailing face instead curves smoothly down to meet the base 20 of the channel at its trailing end 98. As in the previous embodiments, a secondary water flow passageway is provided through the bed form 85 via a vent opening 100 at the trailing end and vent openings 102 on opposite sides of the bed form which extend over the peak of the bed form. The vent openings are covered with gratings for safety.

In this embodiment, the secondary passageway through the bed form, along with the shallow side portions 16 on opposite sides of the deeper channel containing the bed forms, and the shape of the bed forms, tends to create a standing wave 104 at the first bed form 85 and each subsequent bed form in the channel, as in the previous embodiments. The weir and bed forms may alternatively be of solid construction with through passageways, as in FIG. 3.

Figure 7:
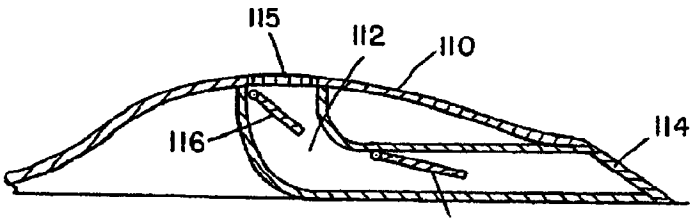
FIG. 7 is a sectional view of a single bed form forming part of a modified wave forming apparatus.

FIG. 7 illustrates an alternative bed form structure 110 which may be used in place of the bed forms 15 of the first embodiment. In this case, rather than permitting flow circulation in the entire area under the bed form, the flow is channeled through one or more passageways 112 via a vent or slot 114 at the trailing end of the bed form, and a vent or slot 115 adjacent the peak of the bed form. Each vent 114, 115 and the associated passageway 112 may extend across the width of the bed form, or two side slots may be provided as in FIGS. 1 and 2 to communicate via spaced passageways with a full width vent 115. Flow control flaps or valves 116 are provided in the passageway 112 to control the secondary flow, so that the size and stability of the subsequent standing wave can be controlled more readily.

Figure 10:
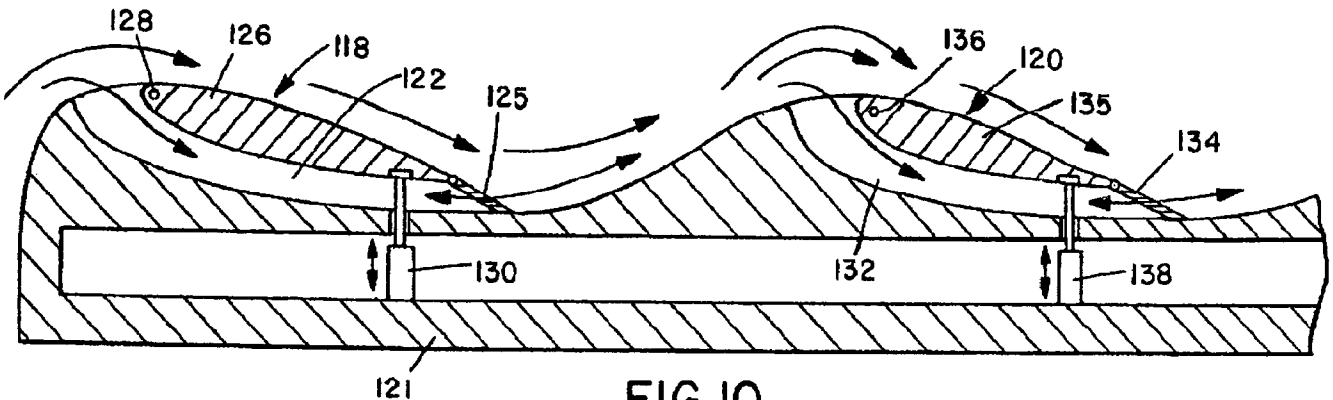
FIG. 10 is an enlarged sectional view similar to FIG. 6, illustrating another embodiment of the wave forming apparatus.

FIG. 10 illustrates a wave forming apparatus according to another embodiment, in which the weir 118 and bed forms 120 are actually molded into the base 121 of the channel, out of concrete or the like. The weir 118 has a passageway 122 extending from the leading end to a trailing end vent covered with a pivoted grating flap 125 which rests freely against the base 121. The upper portion 126 of the weir is pivoted at its leading end via pivot 128 and supported adjacent its trailing end by one or more hydraulic rams 130 spaced across the width of the passageway 122, acting between the base 121 and portion 126. Thus, the secondary flow rate can be readily adjusted simply by extending or retracting ram 130, either lifting the free end of portion 126 to increase the size of vent opening 124, or lowering portion 126 to reduce the vent size.

The bed form 120 is of similar shape to the previous embodiments, and has a secondary flow passageway 132 extending from a location adjacent the peak or highest point of the bed form to the trailing end of the bed form, wherein the vent is again covered with a pivoted grating flap 134 permitting height adjustment. An upper portion 135 of the bed form 120 is pivotally mounted at its leading end via pivot 136, and supported at its trailing end by one or more hydraulic rams 138 spaced across the width of the bed form, extending between base 121 and the portion 135. Again, this permits the size of the trailing end vent, and thus the amount of secondary flow in either direction through channel 132, to optimize the standing wave 139.

Figure 11:
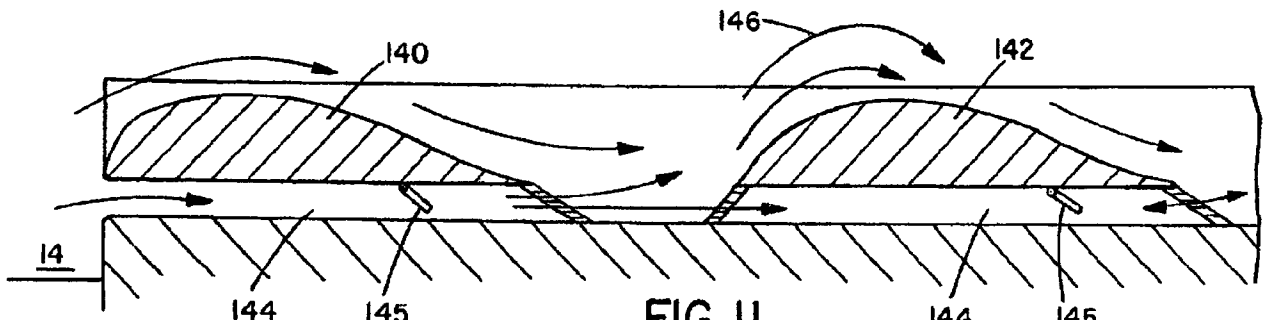
FIG. 11 is a view similar to FIG. 10 illustrating another embodiment of the wave forming apparatus.

FIG. 11 illustrates an alternative embodiment in which both the weir 140 and bed forms 142 have secondary flow passageways 144 extending from the leading end to the trailing end. Each passageway 144 has a flow control valve 145 for adjusting the amount of secondary water flow. The vent openings at each end of the bed form passageways, and the trailing end of the weir passageway, are covered with safety gratings. The bed forms are of similar shape to the previous embodiments, and are mounted in an apparatus similar to that illustrated in FIGS. 1 and 2, with shallow side portions outside the channel containing bed forms 142. As in the previous embodiments, the arrangement is such that rideable standing waves 146 forms adjacent the peak of the first bed form 142 and each subsequent bed form.

Figure 12:
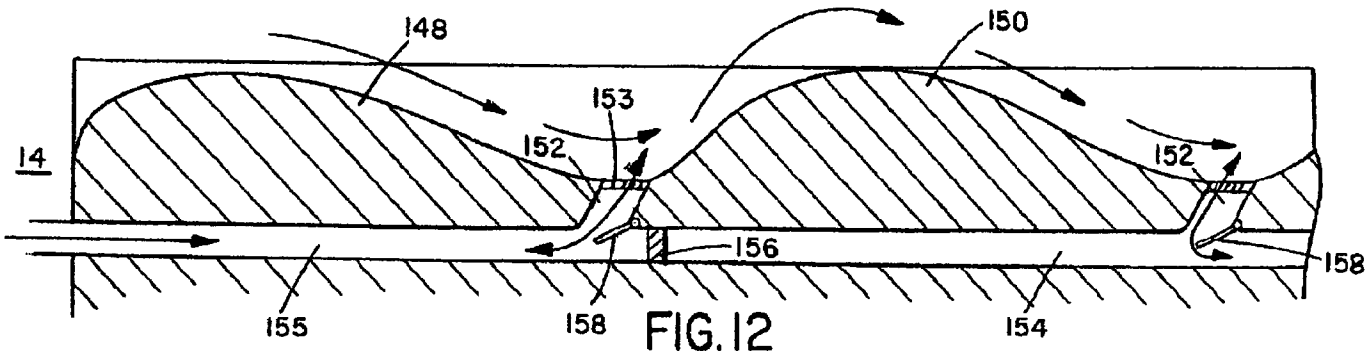
FIG. 12 is a view similar to FIGS. 10 and 11, illustrating another modified embodiment of the wave forming apparatus.

FIG. 12 illustrates another modification in which a weir 148 is followed by subsequent bed forms 150 of similar shape to the previous embodiments. However, in this case, rather than providing a secondary flow passageway extending from the peak or leading end of the bed form to the trailing end of the bed form, secondary water flow is instead provided via a vent passageway or opening 152 located between each adjacent pair of bed forms, and between the weir and first bed form.

The passageways 152 are each covered by a safety grating 153 at their open end and communicate with a single through passageway 154 extending through the base of the channel beneath the bed forms. A first portion 155 of the passageway beneath the weir is cut off from the subsequent portion of the passageway extending beneath the bed forms via wall 156. A flow control valve 158 is provided at the junction between each vent passageway 152 and the base passageway 152. This arrangement helps standing waves to form by permitting flow into and out of the area beneath the standing wave.

The embodiment of FIG. 12 may be incorporated in an apparatus as generally illustrated in FIG. 1 with a central, deeper channel containing the weir and bed forms, and shallow side portions on each side of the channel. The valves 158 provide additional control for adjusting the properties of the standing waves formed over the bed forms.

Figure 13:
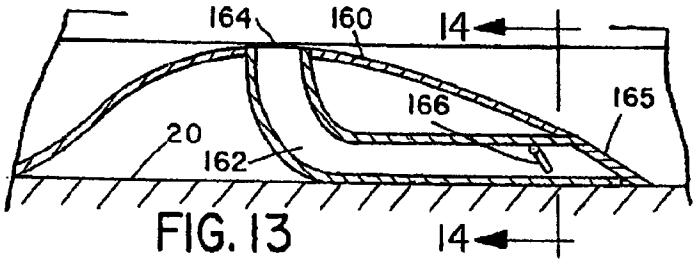
FIG. 13 is a view similar to FIG. 7, illustrating an alternative flow control.
Figure 14:
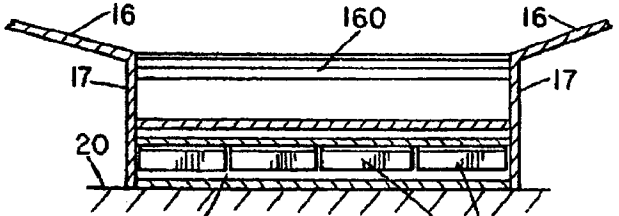
FIG. 14 is a sectional view on the lines 14-14 of FIG. 13.

FIGS. 13 and 14 illustrate another modified bed form 160 which may be used in place of the bed forms 15 of FIGS. 1 and 2 in a wave forming apparatus. The apparatus is otherwise identical to that of FIGS. 1, 2 and 5, and like reference numerals have been used for like parts as appropriate. In FIG. 13, the bed form is of similar shape to that of FIG. 6, although it may have a shape similar to that of FIG. 2, with a re-curved trailing end and a sharp vertical drop off. A secondary flow passageway 162 is provided from a vent opening or slot 164 at the peak of the bed form to a trailing end vent 165 covered by a grating. The trailing end vent 165 extends across the full width of the bed form, as indicated in FIG. 14.

A series of flap valves 166 are provided across the width of passageway 162 adjacent the trailing end vent opening. This allows the opening size to be varied across the width of the vent 165, to produce various effects in the subsequent standing wave formed downstream of bed form 160. For example, by closing the flaps 166 successively across the width of the vent 165, a sideways breaking wave may be produced. With all the flaps open, a stable standing wave is produced.

Figure 15:
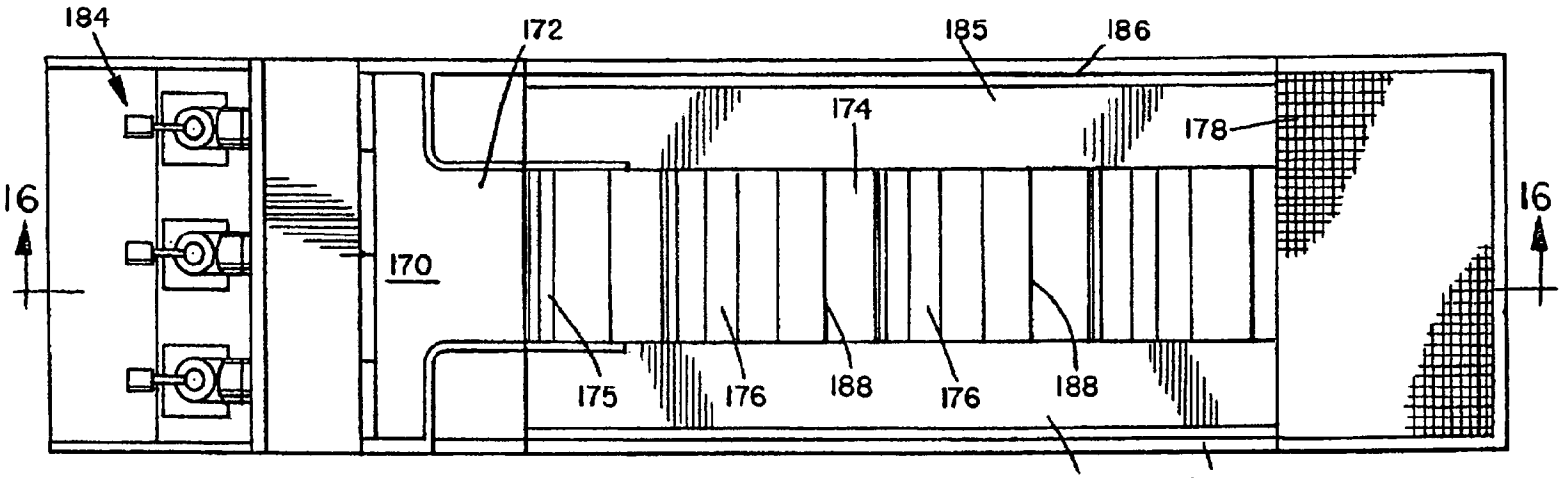
FIG. 15 is a top plan view of a wave forming apparatus according to another embodiment.
Figure 16:
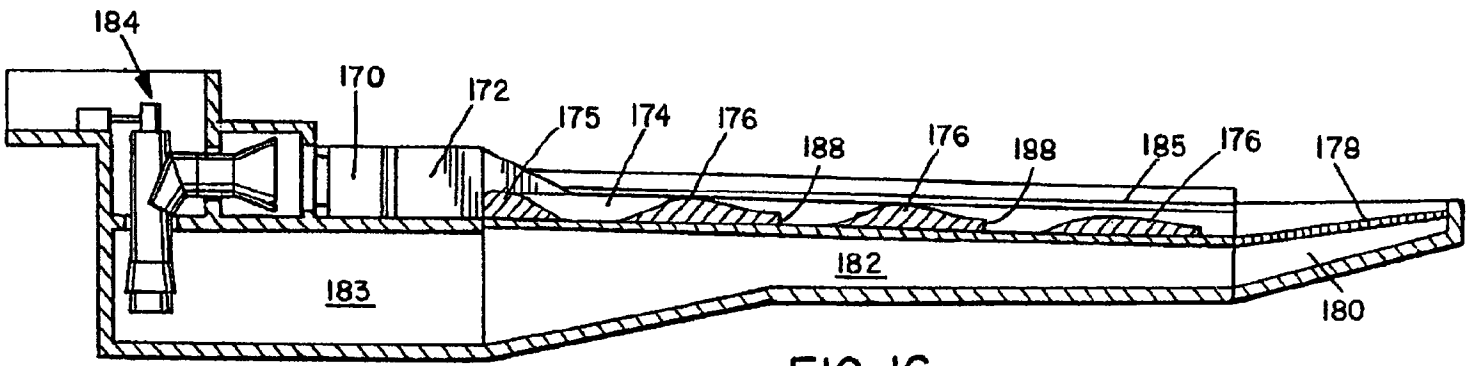
FIG. 16 is a sectional view on lines 16-16 of FIG. 15, illustrating the water re-circulation path.

FIGS. 15 and 16 illustrate a wave forming apparatus similar to that of FIGS. 1, 2 and 5, but showing a possible water re-circulation system for circulating water back to a reservoir at the inlet end of the apparatus. In this embodiment, a raised reservoir 170 at one end of the apparatus supplies water via an elongated inlet 172 to a wave forming channel 174 in which a weir 175 and a series of spaced bed forms 176 are provided. At the end of channel 174, water falls through grating 178 into a chamber 180, and is then re-circulated through a passageway 182 beneath channel 174 back to a chamber 183 beneath the reservoir, where it is re-circulated via pumping system 184.

Other water re-circulation systems may be used, such as passageways around the sides of channel 174, or the outlet end of the wave forming apparatus may be connected to other water rides, and water may then be re-circulated from those rides back to reservoir 170. As in the first embodiment, shallow side portions 185 extend from each side of channel 174 to the outer sides 186 of the apparatus, and this may be inclined slightly upwardly, as in FIG. 5, or may be flat or inclined slightly downwardly. The bed forms 176 of FIG. 16 are solid shaped members similar to those of FIG. 4, without any secondary flow passageways but with an abrupt vertical cut off 188 at the trailing end. However, bed forms 176 may be replaced with any of the other alternative bed forms illustrated in FIGS. 1 to 14. The sides of channel 174 are straight, rather than flaring outwardly as in FIG. 1. However, they may alternatively taper outwardly or inwardly from the leading end to the trailing end of the channel.

In this apparatus, as in the previous embodiments, standing waves are formed downstream of each waveform 176 at the next structure, i.e. the upstream face of the next successive waveform, or, in the case of the last waveform, at the upwardly inclined grating 178. The formation of a standing wave over grating 178 has some advantages. For example, after exiting the wave, the rider can easily stand up in the shallow water over the grafting in order to exit the ride. In another alternative embodiment, a wave forming apparatus may comprise a channel as in the previous embodiments with a series of alternating waveforms and gratings, with each wave being formed over a grating. This separates the riders more effectively. Each successive waveform and grating may be stepped down from the preceding pair, to ensure adequate water flow through the channel.

In each of the above embodiments, water flows over and through a weir at the inlet end of the channel. However, flow may alternatively be provided through side channels extending along opposite sides of the weir, under the control of flap valves.

The wave forming apparatus in each of the above embodiments may create more readily controlled standing waves. A combination of features produces beneficial wave conditions, with some or all of these features being used dependent on the desired form of the standing wave, and what degree of adjustability in the wave formation is required. One key feature is a sequence of two or more shaped bed forms, such that waves tend to be formed at a leading face of the successive bed forms. However, this alone is not sufficient to form a stable standing wave. Another feature which may help to form a standing wave is the provision of secondary flow beneath each bed form, with a vent for flow into or out of the secondary passageway immediately upstream of the desired wave forming location, prior to the leading face of the next bed form. This is believed to provide flow out of or into the space beneath the wave at the wave forming location, enhancing the stability of the wave.

The opposite end of the secondary passageway is provided in most cases at or adjacent the peak or highest point of the bed form, and may comprise a vent across most of the width of the bed form, or two elongated side vents on opposite sides of the bed form centered at the peak. A further feature which produces improved standing waves is the provision of a sharp, vertical cut off at the trailing end of the bed form, so that a trailing end is spaced above the floor of the channel. This alone, without a secondary passage, results in some standing wave formation. However, standing waves are enhanced by providing both a secondary passageway and a sharp cut off, as in some of the embodiments illustrated above. The secondary passageway also provides a convenient means for adjusting the standing wave, by means of height adjusters to vary the height of the trailing end of the waveform, valves to vary the secondary flow, and the like, as illustrated in some of the above embodiments. Adjustment of the size of the trailing end vent across the width of the bed form may be used to create a breaking, curling, or pitching wave. A surge of secondary flow can be created by hinging the bed form so as to first cut off the secondary flow, and then lifting the trailing end of the bed form. By providing a flexible trailing end portion for the bed form, which can lift and lower freely based on flow conditions, an oscillating wave form can be produced.

The bed form shape in each of the above embodiments comprises a concave leading face, a curved peak, and a concave trailing face. This tends to produce a wave at the leading face of the next bed form. In some of the above embodiments, the trailing face continues down to blend smoothly with the base of the channel. However, wave forming is enhanced by providing a re-curve adjacent the trailing end of the bed form, to produce a substantially horizontal tail portion before an abrupt vertical drop off at a predetermined tail elevation factor, or TEF, as illustrated in FIGS. 2 to 4, 7, 8, 11, 12, and 16. This produces standing waves without the secondary passageway for adding or removing water beneath the formed wave.

The flume cross-sectional profile in each of the above embodiments comprises a deeper central channel containing the weir and bed forms for producing waves, and shallower side portions extending outwardly from opposite sides of the channel. This channels the water over the bed forms and prevents too much water from escaping around the bed forms, while allowing the sides of the top portion of each standing wave to vent sideways. This helps to prevent the wave from decaying and enhances stability. The shallow side portions may be tapered slightly upwardly so as to return water back to the center of the channel, although they may alternatively be horizontal or tapered downwardly.

Figure 28:
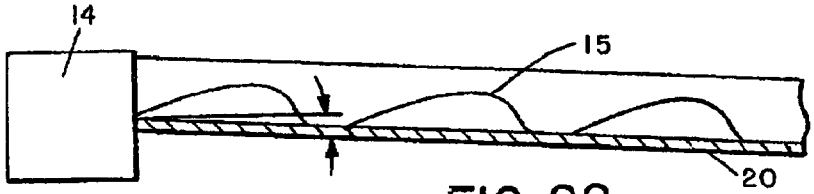
FIG. 28 is a sectional view illustrating a modified wave forming apparatus with a downwardly inclined bed.

In the previous embodiments, the flume or channel is shown as having a substantially flat or even bed or floor 20. However, it may be beneficial in some cases, particularly in channels with a plurality of bed forms for forming multiple standing waves, for the floor 20 to have a slight incline downwards from the channel or flume entrance to the end of the flume, as illustrated in FIG. 28. This inclination may be in the range of 0 to 4 degrees. Rather than a constant inclination along the length of the flume, it may have a shallower portion extending from the entrance and a steeper portion at the lower end, or it may be curved to provide a change in depth along the flume.

Figure 18:
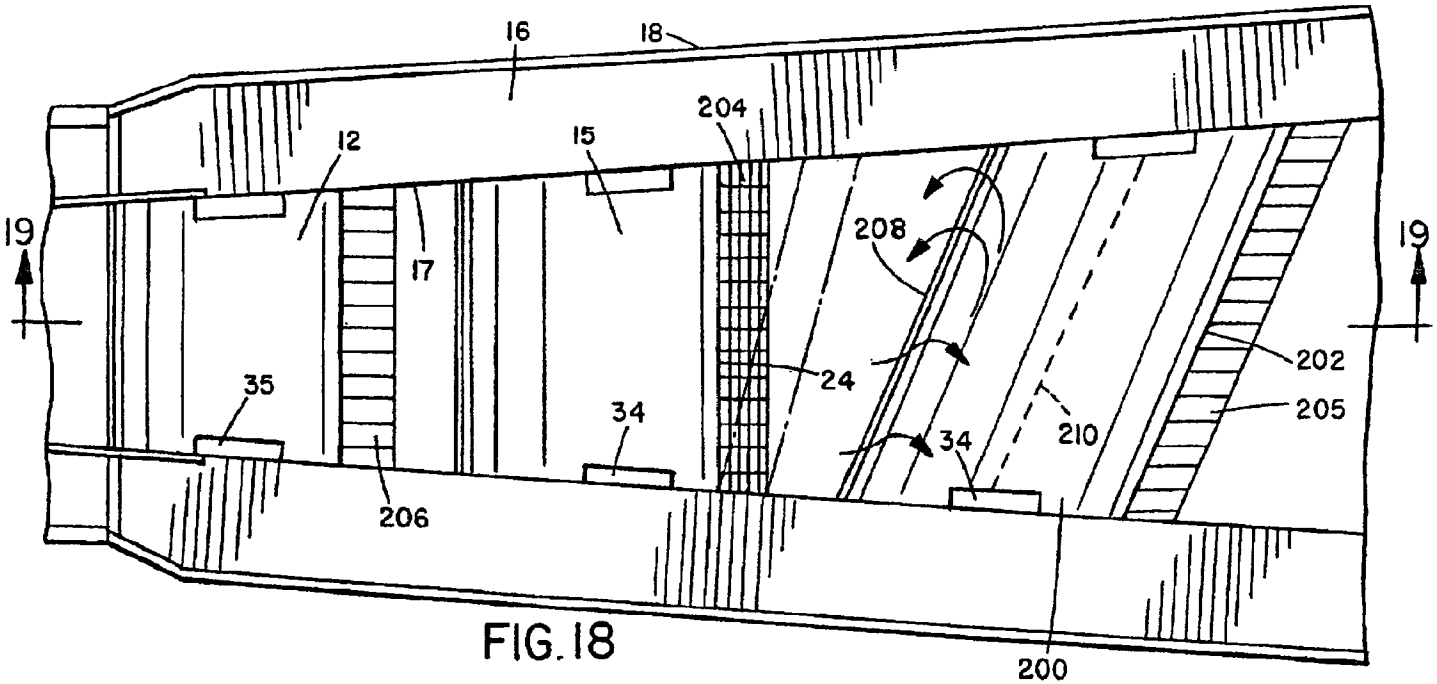
FIG. 18 is a top plan view of a wave forming apparatus according to another embodiment, for forming a standing, curling wave.
Figure 19:
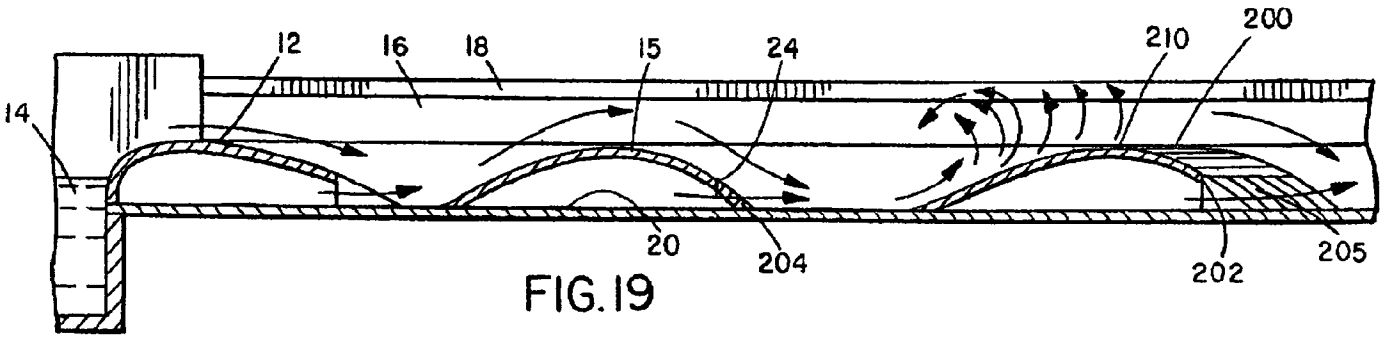
FIG. 19 is a cross-sectional view on the line 19-19 of FIG. 18.

FIGS. 18 and 19 illustrate a wave forming apparatus according to another embodiment. This apparatus is similar to the embodiment of FIGS. 1 and 2, and like reference numerals have been used for like parts, as appropriate. However, instead of a series of bed forms which are each perpendicular to the water flow direction, in this embodiment the last bed form 200 in the channel or flume 10 is oriented at an oblique angle to the water flow. Also, the floor 20 may have a slight declination of the order of 1 to 4°, as in FIG. 28.

As in the previous embodiments, channel 10 has a weir 12 at its inlet end connected to a supply of water in a reservoir 14. A first bed form 15 is positioned downstream of weir 12 in order to create a stable, standing wave. Oblique bed form 200 is positioned downstream of bed form 15. In alternative arrangements, a greater number of bed forms 15 may be provided prior to oblique bed form 200. The channel 10 is of tapering, gradually increasing width along its length, and may be provided with a water re-circulation system at its end as in FIGS. 15 and 16, or may intersect with another channel in other arrangements. Sloping side walls or entry/exit portions 16 extend from the opposite, vertical sides 17 of the wave forming channel or flume 10 to the outer sides 18 of the apparatus.

The weir and bed form 15, as well as the oblique bed form 200, are each of hollow shell construction, although they may be of any of the alternative constructions illustrated in the preceding embodiments. The bed forms 15 and 200 each incline upwardly to a peak, and then incline downwardly to a trailing end 24, 202 which is raised above the bed or base 20 of the channel. An inclined grating 204, 205 extends from the trailing end of each bed form down to the base 20. Grating 206 is also provided over the open, trailing end of the weir 12. The bed forms 15 and 200 each have a pair of elongate side vents 34 along opposite sides of the bed form and extending across the peak of the bed form. Similarly, the weir 12 has a pair of elongate side vents 35. The raised trailing end of each bed form and the vents 34 together form a secondary flow passageway for water through the bed form, as described in connection with the previous embodiments.

The oblique bed form 200 in the illustrated embodiment has an oblique or non-perpendicular leading edge 208 and a peak or ridge line 210 which is at the same oblique angle as the leading edge 208. The trailing edge 202 is shown at the same oblique angle as the leading edge and peak, although it may be at a different angle or even perpendicular to the flow. It is the angle of the leading edge and peak which are critical in creating a standing, curling wave or tube, and the orientation of the trailing edge is dependent on what waveforms, if any, are to be provided downstream of the oblique bed form. It may also be advantageous to rake the trailing edge 24 of the bed form 15 immediately upstream of the oblique bed form 200 to provide the ideal hydraulic conditions for standing wave formation, for example as illustrated in dotted outline in FIG. 18. The angle of the leading edge 208 for creating a curling wave is in the range of 15 to 30 degrees from perpendicular to the flow direction, i.e. 105 to 120 degrees to the flow direction. In the exemplary embodiment, as noted above, the peak or ridge line 210 is at the same angle as leading edge 208, but could vary from this angle in order to create different wave effects.

In this embodiment, the first bed form 15 creates a standing wave with a stable wake as described above, while the oblique bed form creates a standing curling wave. The raked leading edge and slant of the bed form 200 gives water a sideways velocity component which induces the more downstream side to break continuously while the more upstream side remains an unbroken standing wave. Thus, the curling wave is created near the downstream end of the bed form and extends across the bed form, as indicated in FIGS. 17 and 18. The water depth across the wave varies from channel flow depth just prior to the wave to depths almost as high as the wave itself when measured under the peak. The standing tube or curling wave is induced to pitch out continuously by the bottom form of the bed and the ventilated shear wake created by the wave forming structure.

All the motion controls applied to the normal standing wave forming apparatus of the previous embodiments may be applied to the oblique bed form for forming the curling standing wave. Thus, the tail elevation, peak height, flow rate, channel depth, and other parameters may be varied in order to vary the wave.

Figure 20:
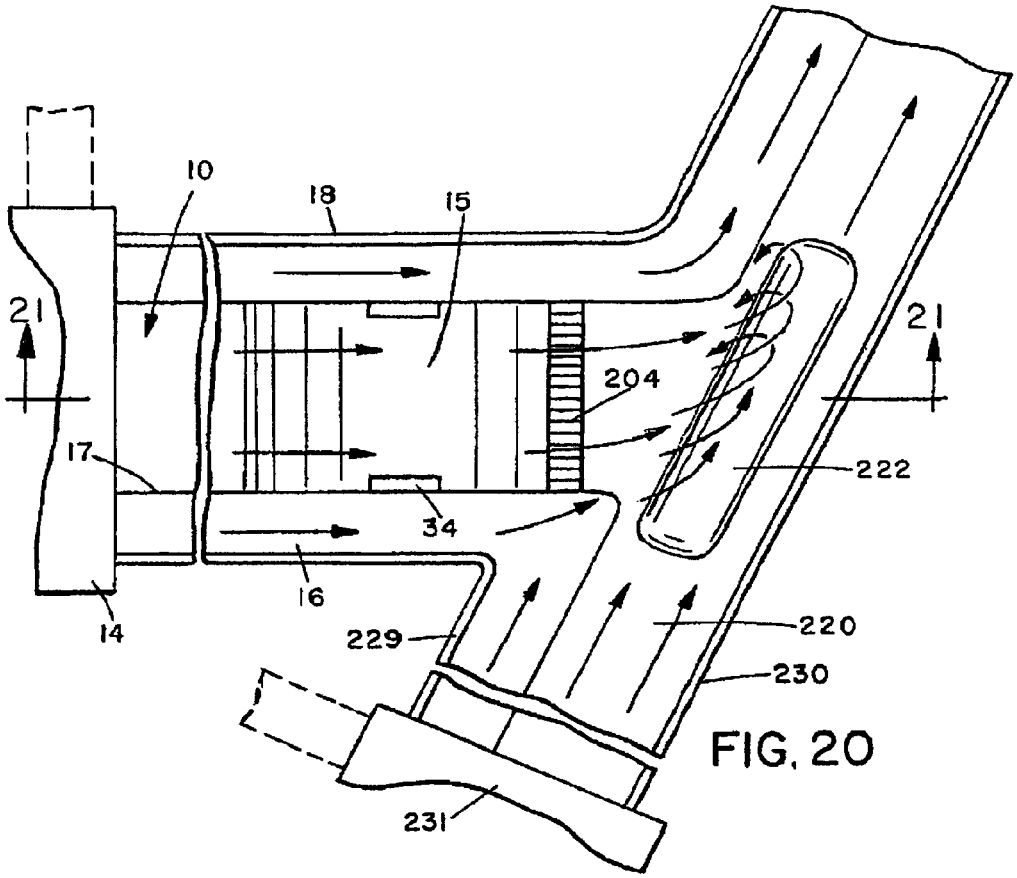
FIG. 20 is a top plan view of an alternative wave forming apparatus for forming a standing, curling wave.
Figure 21:
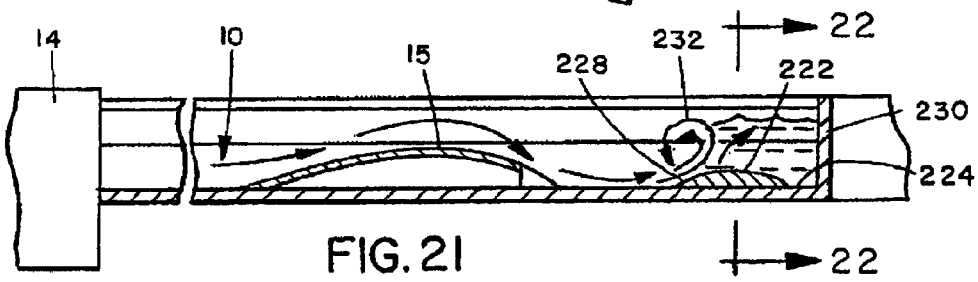
FIG. 21 is a sectional view on the line 21-21 of FIG. 20.
Figure 22:
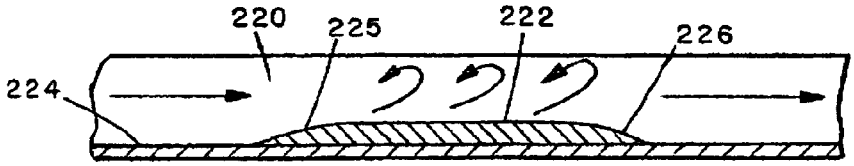
FIG. 22 is a sectional view on the line 22-22 of FIG. 21.

FIGS. 20 to 22 illustrate another embodiment of a wave forming apparatus for creating a standing, curling wave. In this embodiment, instead of providing an oblique bed form in the primary channel 10, another channel 220 is oriented to intersect the end of the primary channel 10 at an oblique angle. The water flowing in the secondary channel or river 220 is deeper than the water flowing along primary channel 10, as indicated in FIG. 21. The primary channel 10 has a weir and a series of bed forms 15 for creating stable standing waves, as in the first embodiment, with only the last bed form 15 being illustrated in FIGS. 20 and 21. The apparatus would also work with only one bed form 15 in the primary channel or flume 10, if no additional standing waves are desired.

A river bed form 222 is provided in the bed 224 of river or secondary channel 220. River or secondary channel 220 has an inner side wall 229 and an outer wall 230. The river is fed from a suitable water supply such as a reservoir 231. The bed form 222 in river 220 may be a solid or hollow bed form, and does not require any secondary flow channels. The bed form 222 is of generally rounded shape and is elongated in the river flow direction, as indicated in FIG. 22, with gradually tapering or smoothly contoured ends 225, 226 merging smoothly with the river bed 224. The leading surface 228 of the bed form 222 facing the primary channel 10 is of convex, rounded shape, as best illustrated in FIG. 21. The leading surface 228 is similar in shape to the flume bed forms 15, and the height of the bed form 222 is less than that of the flume bed forms. The trailing surface shape is not critical and no tail elevation is required, because no downstream wave is created after the curling wave. The bed form shape and length in the river flow direction are not critical. Overall height, position, and leading surface shape are the most critical factors. The ideal position for bed form 222 is at the confluence of the two water flows, but it may be adjusted upstream or downstream slightly for different effects. As noted above, the leading surface shape is approximately the same as the leading surface shape of flume bed forms 15, but the peak is of lower height.

In this embodiment, a curling wave 232 is created at the confluence of the faster flume flow exiting channel 10 with the deeper and slower river flow along channel 222. A stable wake is induced between bed form 15 and bed form 222. The combination of the stable wake and confluence of the two water flows creates a hollow curling wave suitable for riding in the tube of the wave. This wave can be controlled to advance or recede using the motion controls of the bed form apparatus, as described in detail in the previous embodiments, as well as by changing the flow rates and depths of the primary flume and/or river flow. The two reservoir sources 14 and 231 provide a suitable flow rate and velocity to be selected for each flow in order to create the standing, curling wave, and may be adjusted as needed. The curling wave can also be induced to break, advance, and recede by introducing traveling waves into the primary channel or the river flows.

The curling wave 232 is created in part by the depth of the water in the river behind the curling wave, or pooled water level, and partly by the oblique angle of the intersecting flow. Typical hydraulic jumps can be created by introducing faster moving water into slower moving water. The ideal level for the pooled water or intersecting river behind the curling wave 232 is a factor of 1.5 greater than the overall elevation drop from the channel base or flume bottom 20 at the entrance to channel 10 down to the flume bottom at the wave location. Adjusting the pooled water level behind curling wave 232 changes the size and characteristics of the curling wave. If the pooled water level is too high, say a factor of 2 greater than the flume elevation drop, the pooled water may cause the wave to decay. If the pooled water level falls to a factor of 0.7 or less of the flume elevation drop, the wave is eliminated.

In one embodiment, the angle of intersection between the water flows in the primary flume or channel 10 and the river 220 was approximately 75 degrees (i.e. the angle between channel 10 and river 220, but it may be in the range from 30 degrees to 90 degrees. The range of suitable angles depends in part on the velocities of the two flows. For example, two sheet flows (flows with Froude numbers substantially in excess of 5, and approximately 35 and higher in current sheet flow technology practice) can be directed at each other to produce a water effect with the appearance of a curling wave. Any practical angles other than parallel can produce the effect. For standing wave formation, the river flow is typically slower, at subcritical (Froude number less than 1) or faster speeds, producing a hydraulic resistance to the faster flume flow. This, together with the oblique angle of intersection, tends to produce the standing curling wave, with the wave breaking continuously at the downstream end of the intersecting flows and the more upstream end forming an unbroken standing wave. Bed form 222 enhances the standing, curling wave formation. Flume water Froude numbers in the trough just ahead of the standing wave have Froude values in the 1 to 5 range. With standing waves, Froude numbers vary at every location in the flow and are subcritical (less than 1) at the standing wave peak. The river bed form 222 helps to control the position and formation of the standing curling wave.

Figure 23:
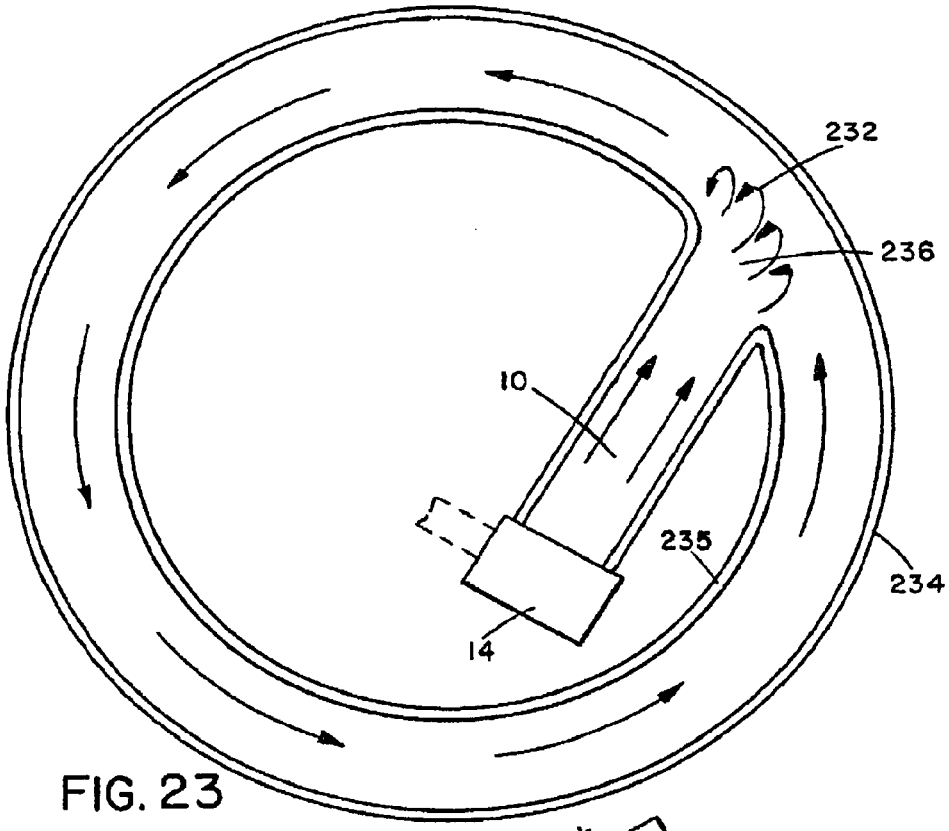
FIG. 23 is a top plan view of a modified wave forming apparatus which is self-circulating.

FIG. 23 illustrates a modification in which, rather than having an independently fed intersecting river flow, as in FIGS. 20 to 22, a continuous loop 234 is provided, with the primary channel 10 intersection the inner wall 235 of the loop at the desired oblique angle. This is a more efficient layout where the river flow is created by the inertia of the flume flow driving the combined flows in a continuous loop. For simplicity, the bed forms in primary channel 10 and in the loop at the intersection 236 between the primary channel and river flow are not shown, but may be identical to those illustrated in FIGS. 20 to 22 in order to create the standing curling wave 232, as well as one or more standing waves in the primary channel 10.

Figure 24:
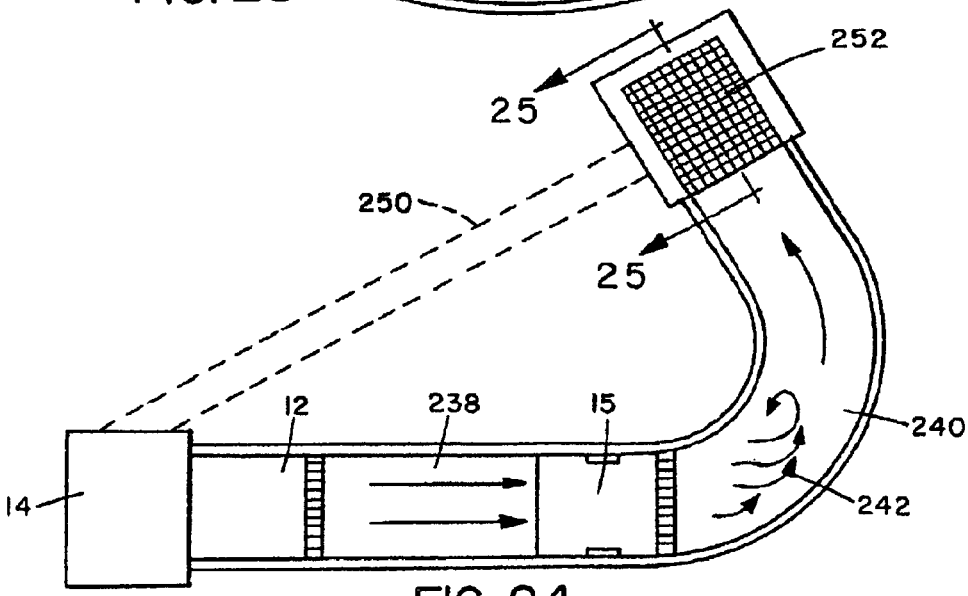
FIG. 24 is a top plan view of a wave forming apparatus according to another embodiment, in which the primary flume is curved to create a standing, curling wave.
Figure 25:
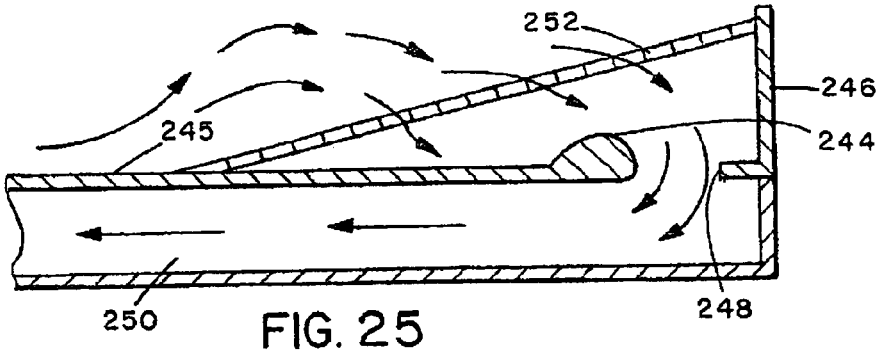
FIG. 25 is a sectional view on the line 25-25 of FIG. 24, illustrating the exit area of the apparatus of FIG. 24.

FIGS. 24 and 25 illustrate another alternative arrangement for creating a standing, curling wave. Instead of a secondary channel or river loop intersecting the primary channel 10, in this embodiment a primary channel 238 has a curve 240 immediately after a standing wave producing bed form 15, inducing a sideways flow component which creates a standing tubing wave 242. The water depth is changed at the curve 240 by providing a weir 244 at the outlet end of the channel which tends to back up water ahead of the tubing wave 242, as indicated in FIG. 25. The weir 244 is provided in the bottom or bed 245 of the channel 238 adjacent the end wall 246, and an outlet opening 248 allows water exiting the channel to flow back along water return passage 250. An inclined safety grille 252 covers the weir 244 and exit opening 248. The weir 244 causes the water to back up, increasing the water depth and slowing the flow rate, which enhances the tubing wave formation.

Figure 26:
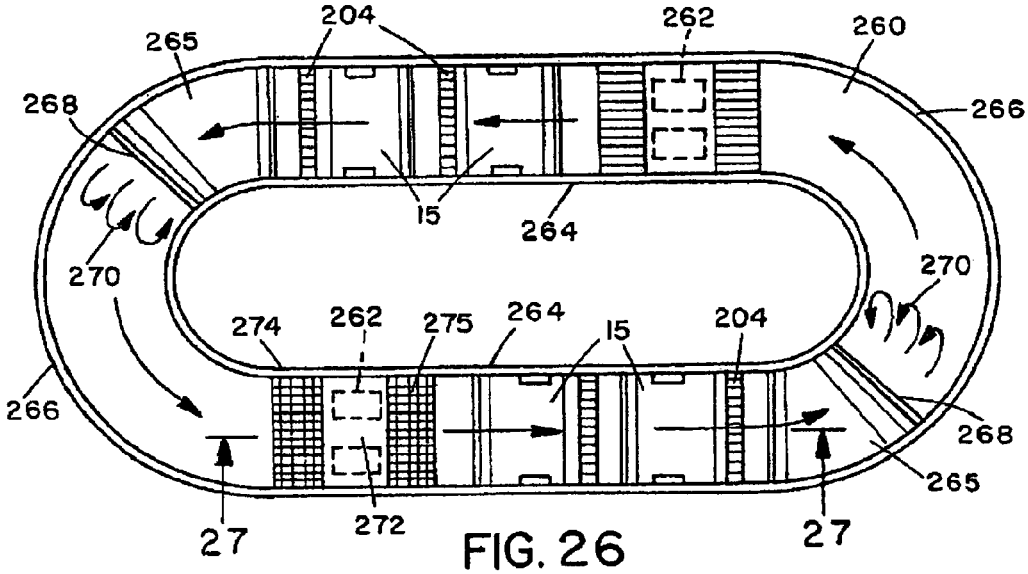
FIG. 26 is a top plan view of a river type wave forming apparatus according to another embodiment.
Figure 27:
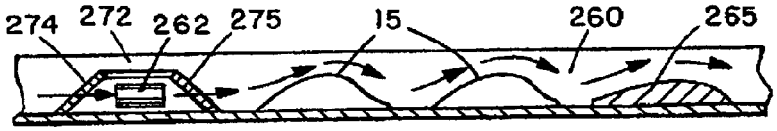
FIG. 27 is a sectional view on the line 27-27 of FIG. 26.

FIGS. 26 and 27 illustrate another alternative wave forming apparatus in which jet pumps replace the reservoir in creating the primary flume flow ahead of the bed forms. In this embodiment, the flume or channel 260 is in the form of an elongated river loop, with jet pumps 262 provided at the start of each straight side portion 264 of the loop in the flow direction. One or more standing wave forming bed forms 15 are provided in each straight side portion 264, and these have venting as in the previous embodiments for creating standing waves. A second type of bed form 265 is provided at the start of each curled end 266 of the loop. This has no venting and is shaped at its trailing end 268 to conform with the bend in the channel, as indicated in FIG. 26. The bed forms 265 are lower in height than the bed forms 15. With this arrangement, one or more standing waves are produced at bed forms 15, while a curling standing wave 270 is produced at each curve or bend in the river loop.

The jet pump arrangement is illustrated in more detail in FIG. 27. As illustrated, jet pumps 262 are arranged in pairs inside a housing having a flat upper wall 272, an inclined inlet grille 274, and an inclined outlet grille 275. Water is drawn through the inlet grille and out through the exit grille, as indicated, in order to circulate water at the desired flow rate. The river loop 260 may be elongated if a greater number of standing wave bed forms 15 is desired.

Figure 29:
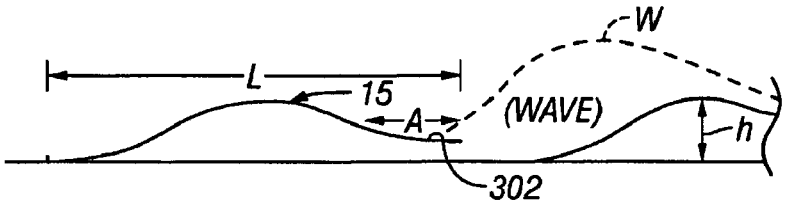
FIG. 29 is a schematic side elevational view of a bed form with a first tail length, as well as the standing wave formed after the bed form.
Figure 30:
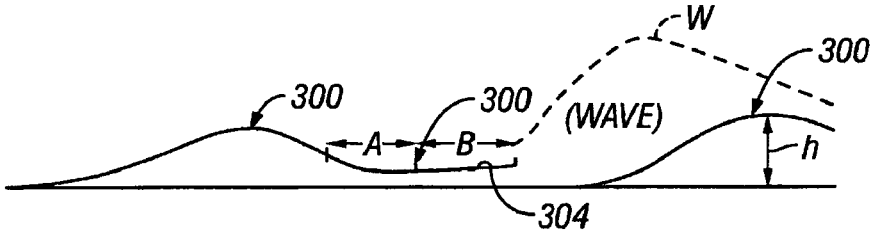
FIG. 30 is a side elevational view similar to FIG. 29, illustrating an extended tail to provide more room for surfboards to maneuver in front of the face of the wave.

FIG. 30 illustrates a bed form 300 with a modified, extended tail 301 which may be provided on the weir and additional bed forms of any of the preceding embodiments, while FIG. 29 illustrates a tail 302 of the same general extent as in FIG. 3, 4, or 8, for example. The tail 302 has a length A, while the tail 300 has an extended, flat or generally horizontal end portion 304 of length B. If the overall length of the bed form from the leading end to the end of the tail in FIG. 29 is L, and the length of the extended portion 304 in FIG. 30 is LB, then the length LB in an exemplary embodiment is of the order of 25% to 50% of length L, and the overall bed form length L' is L+LB, in other words 25% to 50% longer than in FIG. 29. The extended tail portion is at least three feet in length and may be up to ten feet in length in an exemplary embodiment. In the exemplary embodiment, the length is arranged to be at least equal to the approximate length of a surfboard to allow room for maneuvering.

The advantage of having an extended, generally flat tail portion is that it provides more room for maneuvering a surfboard in front of the face of the wave W formed downstream of the bed form, as indicated in FIG. 30. This is particularly useful for riders with longer surfboards.

Figure 31:
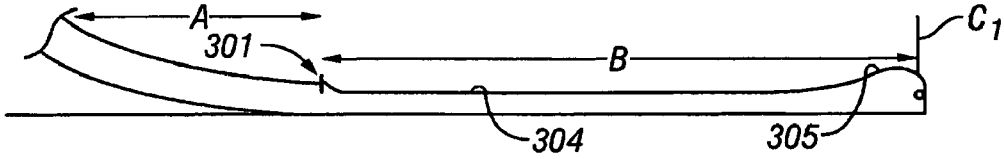
FIG. 31 is an expanded partial side elevational view illustrating a spoiler formed near the end of the tail of FIG. 30.

A raised bump or spoiler 305 may be formed at the end of the extended tail portion 304 of FIG. 30, as indicated in the enlarged view of FIG. 31. A spoiler is an abrupt rise near the end of a bed form tail. The spoiler has a smooth, upwardly inclined leading face with a rounded top for safety. The height of the spoiler may be in the range from about 5% to about 30% of the height h of the bed form peak.

Figure 32A:
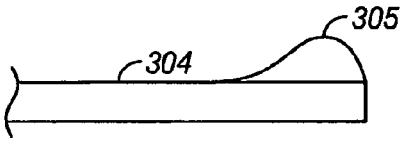
FIGS. 32A to 32D are partial side elevational views similar to FIG. 31 illustrating alternative spoiler shapes.
Figure 32B:
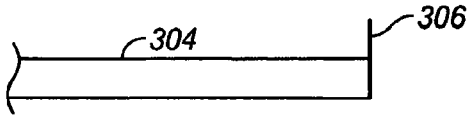
Figure 32C:
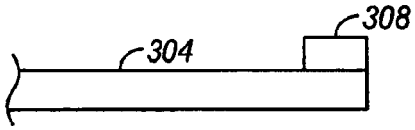
Figure 32D:
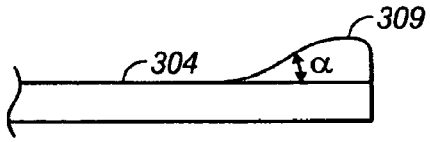

FIGS. 32A to 32D illustrate some alternative spoiler shapes. FIG. 32A illustrates a spoiler 305 of similar shape to FIG. 31. FIG. 32B illustrates a straight vertical spoiler 306 at the end of the tail portion 304. FIG. 32C illustrates an alternative square or rectangular spoiler 308. FIG. 32D illustrates a spoiler 309 having an extended peak and a leading end ramp at an angle which may be between 30 and 60 degrees.

The advantage of a spoiler at the end of the tail is that it allows the wave to form over a wider range of flow rates, which improves efficiency and allows for a wider range of wave heights in a given arrangement of bed forms. Without such a spoiler, an equivalent bed form creates a wave which is not as high, or more water can be supplied into the channel to make the wave as high. The bump or spoiler creates turbulence which helps to support the standing wave, and also forms a higher wave for a given flow rate. Although the spoiler is shown at the end of extended tail section 304 in the illustrated embodiment, it may also be provided on the end of a shorter tail as in the previous embodiments, or at the trailing end of a bed form with no tail.

Figure 33:
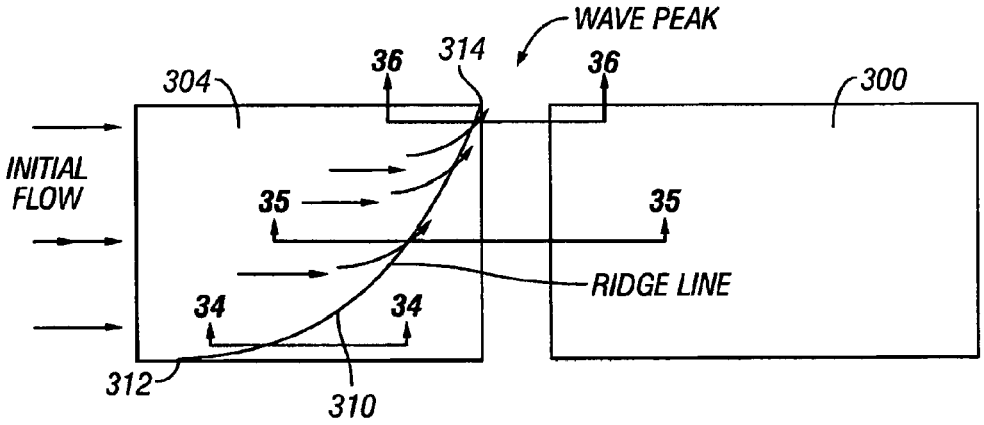
FIG. 33 is a schematic top plan view of the tail of FIG. 31, illustrating an optional curved spoiler.
Figure 34:
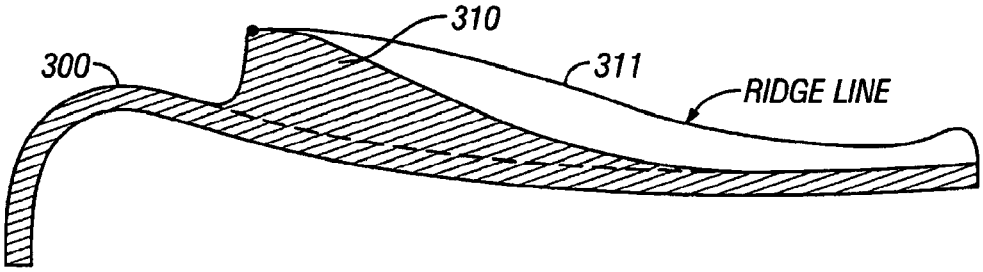
FIG. 34 is a cross-section on the lines 34-34 of FIG. 33.
Figure 35:
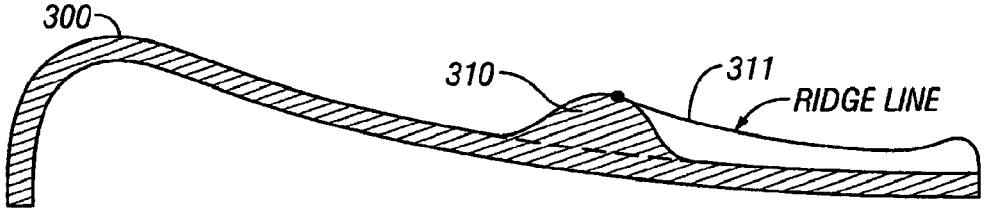
FIG. 35 is a cross-section on the lines 35-35 of FIG. 33.
Figure 36:
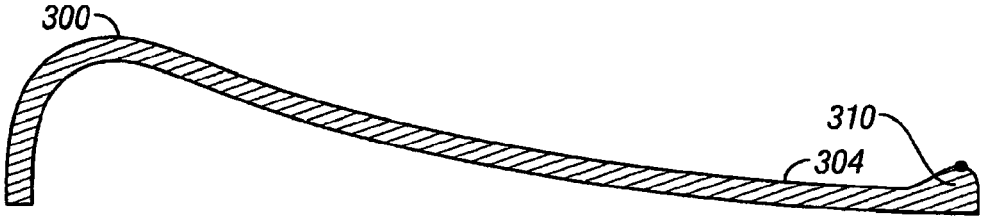
FIG. 36 is a cross-section on the lines 36-36 of FIG. 33.

The spoiler may extend straight across the end of the tail in a direction transverse to the flow direction. FIG. 33 illustrates an alternative spoiler 310 which has a ridge line which is curved across the width of the spoiler from one side of the tail to the other. This is a current deflecting or flow redirecting spoiler, and begins at a point 312 which is upstream of the tail on one side of the wave form and blends into the standard spoiler shape at the end of the tail on the other side 314 of the wave form. The spoiler 310 is tallest at its leading edge and is reduced in height as it curves around and blends into the end of the tail, as illustrated in FIGS. 34 to 36. FIG. 34 illustrates the cross-sectional shape of the spoiler 310 at a location close to the point 312, where it is at its tallest elevation. As illustrated in FIG. 35, the spoiler is reduced in height as it extends across the width of the bed form, and is at its lowest elevation when it blends into the tail, as illustrated in FIG. 36.

The curved or flow shearing spoiler 310 of FIGS. 33 to 36 creates a current of water running from the upstream end of the spoiler towards the downstream end 314 of the spoiler. This oblique or crosswise flow component, combined with the direct downstream flow, creates a peak wave offset from the centerline of the bed form. This standing wave has a component of flow moving laterally towards the peak which creates a unique wave riding experience of predominantly angled riding. This may also help to create a curling or tubing standing wave.

Figure 37:
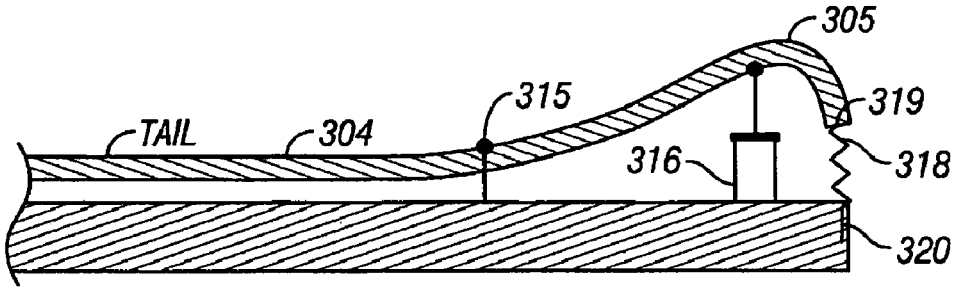
FIG. 37 is a side view of an adjustable spoiler.

The spoiler may be adjustable in height so that it can be optimized for a particular flow rate, as illustrated schematically in FIG. 37. The spoiler 305 is hinged to the end of the tail portion 304 via hinge 315 or may alternatively be made of flexible material. A suitable actuator 316 such as a pneumatic or hydraulic ram or the like is mounted beneath the spoiler to act between the base and the spoiler, so that extension of the actuator increases the height of the spoiler. An expandable safety cover or enclosure 318 is positioned between the end 319 of the spoiler and the base 320 of the channel.

The spoiler 305 may be segmented across the width of the tail portion 304, with each segment being independently adjustable in height. Alternatively, a single piece spoiler may have different portions at varying elevations across the width of the tail.

Figure 38:
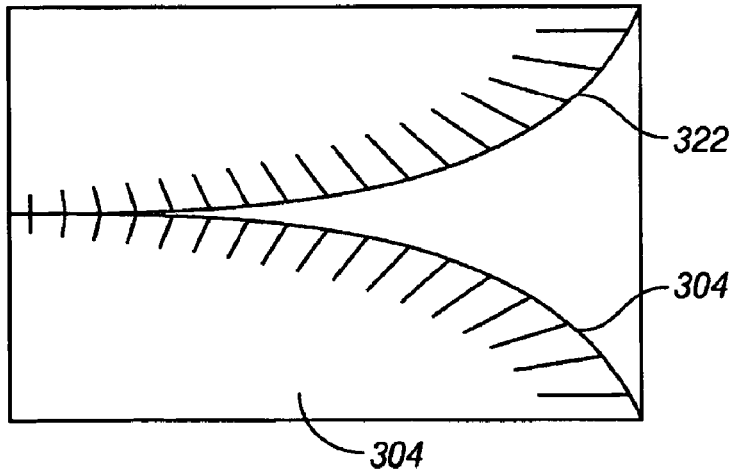
FIG. 38 is a top plan view of the tail of a bed form illustrating a modified, segmented spoiler.

More than one spoiler may be used to create multiple wave peaks in a given width of flow. FIG. 38 illustrates one example of a spoiler which splits into two spoiler sections 322, 324 which curve outwardly in opposite directions towards opposite sides of the tail portion 304. This creates two standing wave peaks.

Figure 41:
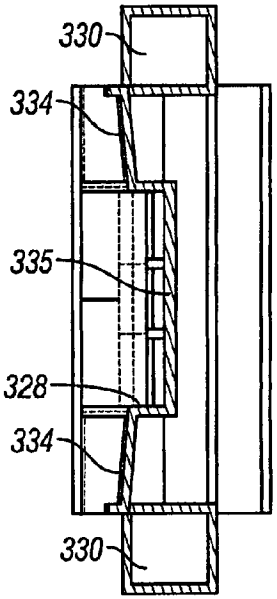
FIG. 41 is a sectional view taken along lines 41-41 of FIG. 40.
Figure 39:
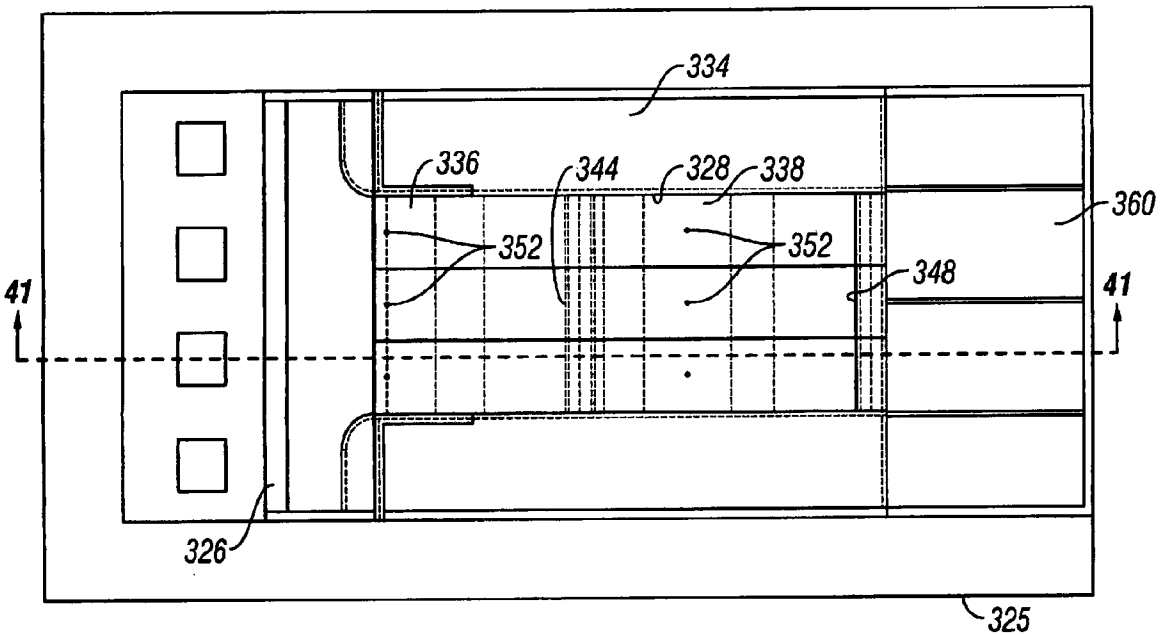
FIG. 39 is a top plan view illustrating a modified spoiler arrangement with two curved segments for splitting the flow.
Figure 40:
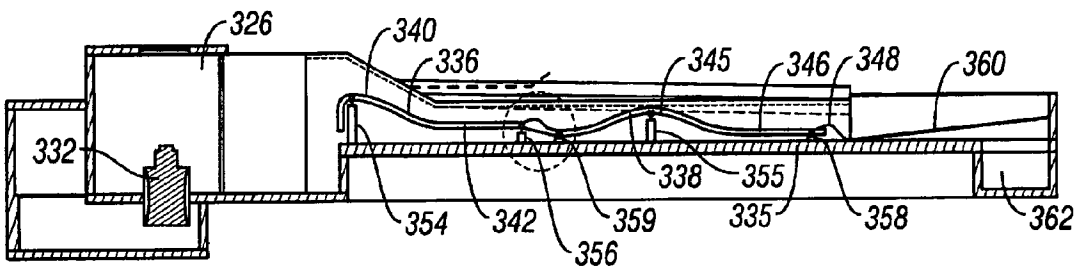
FIG. 40 is a top plan view of a modified wave forming apparatus incorporating the extended tail and spoiler arrangement of FIGS. 30 and 31 at the end of each bed form.

FIGS. 39 to 43 illustrate a wave forming apparatus according to another embodiment which incorporates the extended tail of FIG. 30 as well as the spoiler of FIG. 31. The apparatus basically comprises an outer housing 325 having a water supply or reservoir 326 at one end and a channel 328 extending from the reservoir to the exit end of the ride for containing a flow of water. Water is re-circulated from the exit end of the ride along side channels 330 back to the reservoir, under the action of one or more pumps 332. As in previous embodiments, side river banks or beaches 334 extend outwardly from opposite sides of the channel to provide for ride entry and exit. These may be completely horizontal in the transverse direction, as illustrated in FIG. 17, or have a slight downward slope, rather than being inclined upwardly as illustrated in FIG. 41. Regardless of the transverse angle of the side beaches 334, each beach has a slight downward slope in the longitudinal direction from the inlet end or reservoir end to the exit end, as illustrated in FIG. 16 and FIG. 40. The slope is sufficient to allow water to drain, so that wave control is maintained. The slope of the side beaches 185 in FIG. 16 is around 2.5%, but a slope of 1% is sufficient in most cases.

As best illustrated in FIGS. 40 and 41, channel 328 has a base or lower wall 335. A weir bed form or first bed form 336 is formed at the exit from the reservoir 326, and at least one additional bed form 338 is spaced downstream from the weir bed form. Weir bed form 336 has a peak 340 at its leading end and then slopes downwardly to an extended, generally flat or horizontal tail 342, with a spoiler 344 formed at the trailing end of tail 342. The additional bed form 338 has an upwardly inclined upstream face, a peak or upper portion 345, and a downwardly inclined downstream face extending into an extended flat tail 346 with a spoiler or bump 348 at its trailing end. Spoilers 344 and 348 are substantially identical in shape and dimensions.

Figure 42:
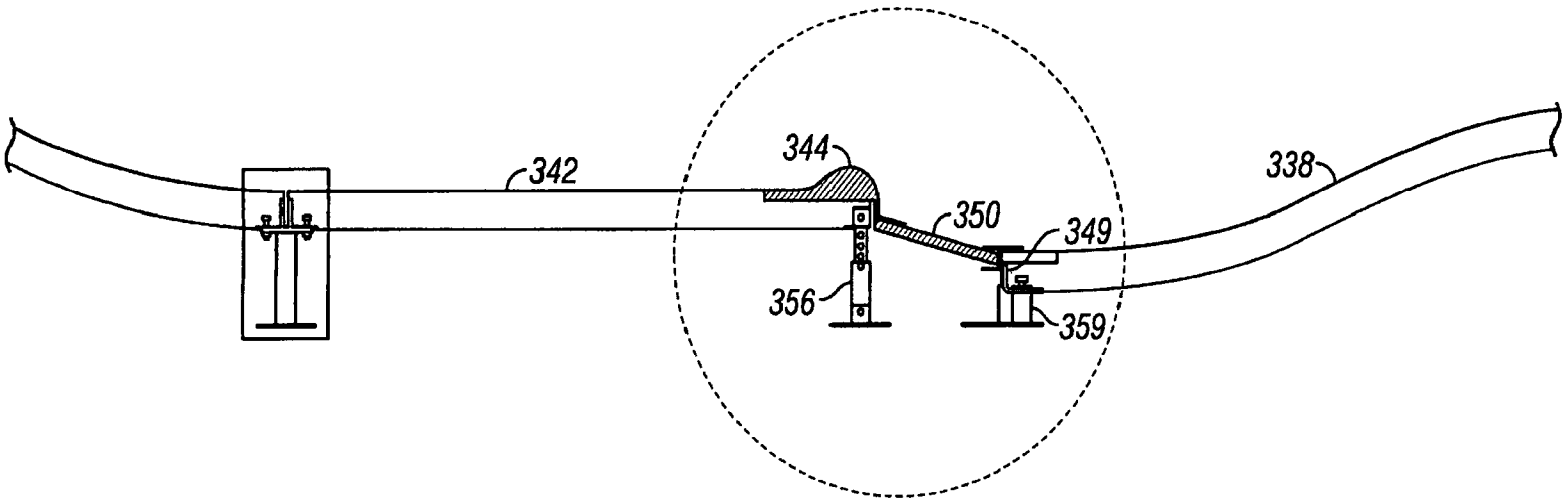
FIG. 42 is an enlargement of the circled region of FIG. 41, illustrating the transition or bridge between the spoiler and the leading edge of the next wave form.

The bed forms 336, 338 of this embodiment are of hollow construction, similar to the first embodiment described above, and have vents for providing a secondary flow path. They may alternatively be of solid construction as in some of the other embodiments described above. As illustrated in FIG. 42, the end of the first spoiler 344 is connected to the leading end of the next bed form 338 via a bridge 350 which may be a grating or have vents forming one end of the secondary flow path. Spaced vents 352 across the peak form the other end of the secondary flow path. These smaller vents replace the side vents of the first embodiment. A similar secondary flow passageway is associated with the additional bed form 338, which also has vents 352 across its peak, and also has a grating at its exit end.

A first peak adjuster 354 is located under the peak of the weir bed form 336 for adjusting the height of the peak. A similar peak adjuster 355 is provided under the peak of the additional bed form 338. Separator plate 349 (see FIG. 42) separates the flow under the weir bed form from the water flow under the additional bed form 338. A tail adjuster 356 for adjusting the height of spoiler 344 is provided under the end of the tail 342, adjacent the spoiler, while a second tail adjuster 358 is located adjacent spoiler 348. Adjusters 356 and 358 adjusts the height of the two spoilers. A leading edge adjuster 359 is located under the leading edge of the additional bed form 338, as best illustrated in FIG. 42. The adjusters allow flexibility in varying various parameters of the apparatus to adjust the wave conditions.

An upwardly inclined exit grating or beach 360 extends from the end of the channel to the end of the housing. Water draining through the grating 360 is returned to the side channels 330 via drain chamber 362 and flows back to the reservoir.

Figure 43:
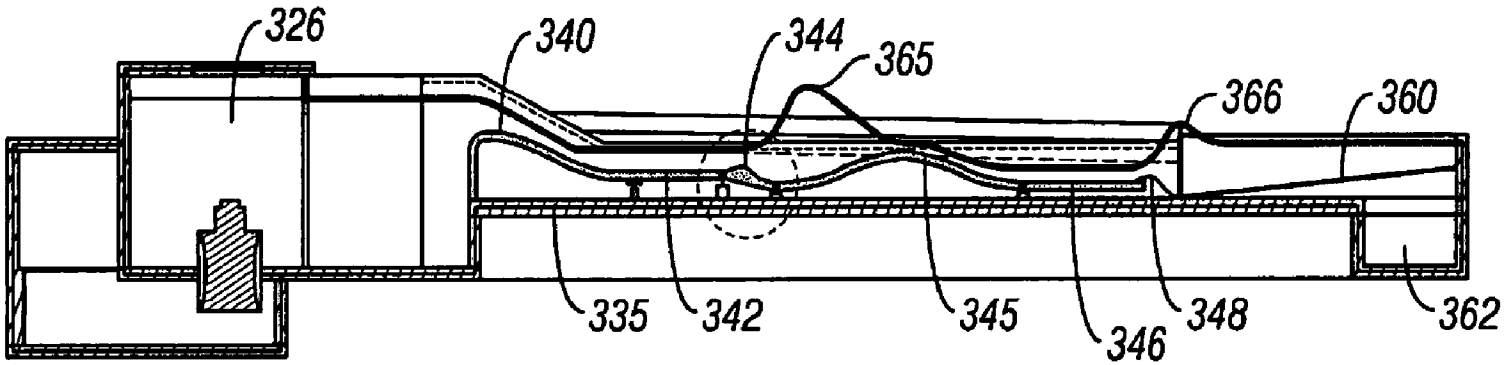
FIG. 43 is a sectional view similar to FIG. 41 illustrating the waves formed by the apparatus.

FIG. 43 illustrates an approximate operating water surface profile 364 in the apparatus of FIGS. 39 to 42 when the apparatus is operated in a critical flow or stream rate. As illustrated, a first standing wave 365 forms downstream of the first spoiler 344, and a second, smaller standing wave 366 forms downstream of the second spoiler 348. Adjustment of the flow rate varies the height of the waves, and waves form over a larger range of flow rates than in the previous embodiments, due to the addition of the spoilers.

Figure 44A:
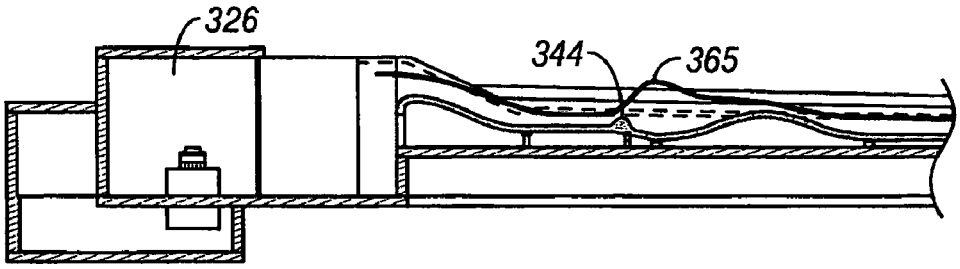
FIG. 44A is a sectional view similar to FIG. 43 illustrating one type of wave formed by the apparatus at a first flow rate.
Figure 44B:
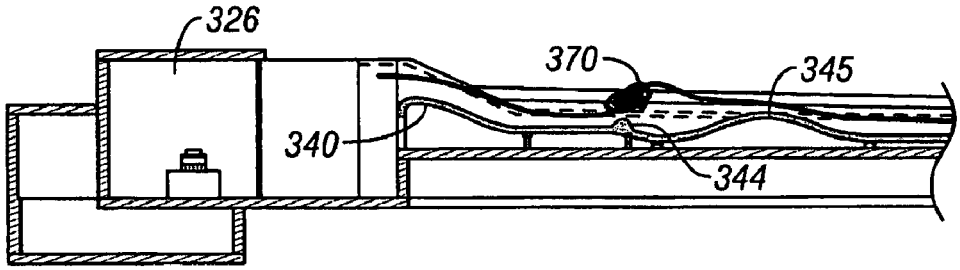
FIG. 44B is a sectional view similar to FIG. 44A illustrating another type of wave formed at a lower flow rate.

FIGS. 44A and 44B illustrate two different types of wave formed with the apparatus of FIGS. 39 to 43 at different flow rates. FIG. 44A illustrates a stable standing wave which is formed at the critical flow rate or stream rate. If the flow rate is decreased sufficiently, a breaking roller 370 is formed, as illustrated in FIG. 44B. This may be desirable for some riders. The Froude number at which a rideable standing wave is formed in the apparatus of FIGS. 39 to 43 is generally around 2.3 to 4.3, with the wave starting to break at the higher number. This range may be extended to 1 to 5 in some cases.

Figure 45A:
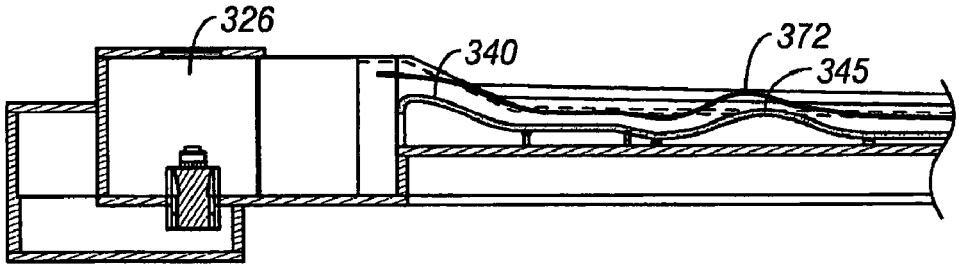
FIG. 45A is a sectional view of a wave forming apparatus similar to that of FIGS. 39 to 44 but with no spoiler, illustrating a first type of wave formed at a first flow rate.
Figure 45B:
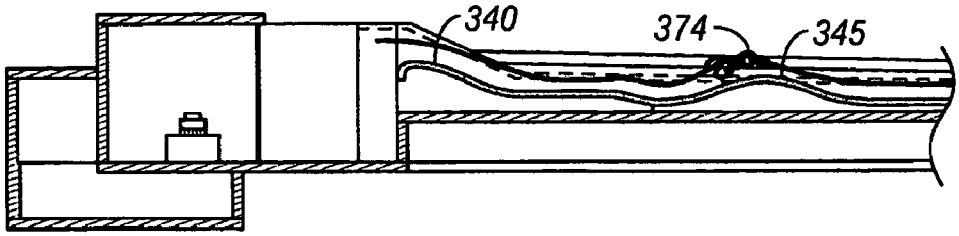
FIG. 45B is a sectional view of the apparatus of FIG. 45A illustrating a second type of wave formed at a second, lower flow rate.

FIGS. 45A and 45B illustrate different types of waves which can be formed with an apparatus similar to that of FIGS. 44A and 44B, having an extended tail on each wave form but without the spoiler 344. FIG. 2 illustrates a stable standing, deep water wave 56 which is similar to the standing wave formed in the apparatus of FIGS. 45A and 45B at the critical flow rate. If this flow rate is reduced, the wave is lowered, until a green face, tapered stream wave 372 is formed. This wave is more shallow than wave 56 and tends to follow the shape of bed form 345, but is deeper at its peak than the water depth at other locations in the channel. If the flow rate is reduced even further, a breaking roller tapered stream wave 374 is formed. Such waves may be desirable in some circumstances. The useful range of Froude number for the apparatus of FIGS. 45A and 45B to form a stable standing wave is lower than that for the apparatus of FIGS. 39 to 44, and is in the range of around 1 to 2.3.

The extended horizontal tail portions of the bed forms in FIGS. 39 to 45 provide an increased distance between wave peaks and also allow more room for surfboards to maneuver in front of the face of a wave. The spoiler or raised formation at or close to the end of the tail allows waves to form over a wider range of flow rates and thus provides a wider operating range for the apparatus. The spoiler creates turbulence which tends to support the wave over a wider range of conditions. As noted above, such a spoiler improves operating efficiency whether used in conjunction with an extended tail, as in FIGS. 39 to 42, or at the end of a wave form with a shorter tail, as in the embodiments of FIGS. 1 to 28.

The enhanced, stable, stationary wave formation, as well as the standing curling wave formation of FIGS. 18 to 27, may have applications outside the field of water amusement parks. For example, suitably shaped bed forms may be provided at the spillway of a dam. This would allow for standing wave creation which would spread energy more quietly and reduce the mist that is produced in standard dam spillways. In turn, this would reduce erosion. In another related application, this bed form and flume technology can be provided in aqueducts and sumps to remove sediment and prevent sediment accumulation. Another possible application would be as a water-based arcade attraction of the type using radio controlled boats or surfers. In this case, the apparatus would be made at around one quarter of the normal water ride scale. It may also be used in a stand-alone water toy. The apparatus may also be used for a purely ornamental water attraction in parks and the like.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A wave generating apparatus, comprising:

a channel which contains a flow of water, the channel having an inlet end connected to a water supply, a base, spaced side walls, and an exit end;

a first bed form in the base at the inlet end of the channel, and at least one second bed form in the channel downstream of the first bed form;

each bed form having a leading end and a trailing end, and an upper portion which is spaced above the base of the channel, each bed form extending at least substantially across the channel to define a primary water flow path from the inlet over the bed forms; and at least one bed form having a downwardly curved downstream face extending from the upper portion of the bed form, the downstream face transitioning to a substantially horizontal tail portion.

2. The apparatus as claimed in claim 1, wherein the horizontal tail portion has a length of approximately three to ten feet.

3. The apparatus as claimed in claim 1, comprising a flume having a first end, a second end, and outer sides, the channel containing the bed forms extending along a central portion of the flume from the first end to the second end, and the flume having side portions on opposite sides of the channel extending from the respective channel side wall out to the opposite sides of the flume, the side portions of the flume being shallower than the channel.

4. The apparatus as claimed in claim 3, wherein each side portion has a downward slope towards the exit end of the flume.

5. The apparatus as claimed in claim 3, wherein the upper portion of the second bed form has a height equal to or less than the height of the side portions located adjacent the upper portion of the second bed form, whereby a wave formed in the vicinity of the bed form spreads laterally onto the side portions at the second bed form.

6. The apparatus of claim 1, further comprising vents in the channel upstream of the second bed form which allow water to drain from the channel.

7. A wave generating apparatus, comprising:

a channel which contains a flow of water, the channel having an inlet end connected to a water supply, a base, spaced side walls, and an exit end;

a first bed form in the base at the inlet end of the channel, and at least one second bed form in the channel downstream of the first bed form;

each bed form having a leading end and a trailing end, and an upper portion spaced above the base of the channel, each bed form extending at least substantially across the channel and defining a primary water flow path from the inlet over the bed forms; and the first bed form having a downstream face which extends from the upper portion of the bed form and has a first, downwardly curved portion transitioning to a second, substantially horizontal tail portion located between the first and second bed forms.

8. The apparatus as claimed in claim 7, further comprising a raised spoiler formed adjacent the end of the horizontal tail portion, the raised spoiler being closer to the second bed form than the first bed form.

9. The apparatus as claimed in claim 8, wherein the upper portion of the additienal second bed form has a peak height and the spoiler has a height in the range from about 5% of the bed form peak height to about 30% of the bed form peak height.

10. The apparatus as claimed in claim 8, wherein the spoiler has an upwardly inclined leading face and a substantially vertical trailing end face.

11. The apparatus as claimed in claim 10, further comprising a grating associated with the spoiler.

12. The apparatus as claimed in claim 10, further comprising a grating downstream of the leading face of the spoiler and prior to the second bed form.

13. A wave generating apparatus, comprising:

a channel which contains a flow of water, the channel having an inlet end connected to a water supply, a base, spaced side walls, and an exit end;

a first bed form in the base at the inlet end of the channel, and at least one second bed form in the channel downstream of the first bed form;

each bed form having a leading end and a trailing end, an upper portion, and a downwardly inclined downstream face extending from the upper portion to the trailing end, each bed form defining a primary water flow path from the inlet over the bed forms;

the first bed form having a downstream face extending from the upper portion of the bed form and having a first, downwardly curved portion transitioning to a second, substantially horizontal tail portion; and the tail portion comprising an extended, uninterrupted flat tail portion extending up to the leading end of the second bed form which does not rise above the height of the leading end of the second bed form at any point.

14. A wave forming apparatus, comprising:

a channel for containing a flow of water, the channel having an inlet end connected to a water supply, a base, and spaced side walls;

a first bed form in the base at the inlet end of the channel, and at least one additional bed form in the channel downstream of the first bed form;

each bed form having a leading end and a trailing end, an upper portion, and a downwardly inclined downstream face extending from the upper portion to the trailing end, the bed forms extending outwardly to the side walls to define a primary water flow path from the inlet over the bed forms; and a raised spoiler in the base of the channel forming an abrupt rise located downstream of the first bed form and upstream of the leading end of the additional bed form.

15. The apparatus as claimed in claim 14, wherein the spoiler has an upwardly inclined leading face and a substantially vertical downstream face.

16. The apparatus as claimed in claim 15, further comprising a grating in the channel located at the downstream end of the spoiler.

17. The apparatus as claimed in claim 14, further comprising a substantially horizontal tail portion between the first and second bed form which is no higher than the leading end of the additional bed form.

18. The apparatus as claimed in claim 17, wherein the spoiler is located adjacent the downstream end of the horizontal tail portion.

19. The apparatus as claimed in claim 14, wherein the spoiler has a ridge line which is curved across the width of the bed form from a first location upstream of the trailing end on one side of the bed form to a second location at the trailing end on the opposite side of the bed form.

20. The apparatus as claimed in claim 14, further comprising an adjuster for adjusting the height of the spoiler.

21. A wave forming apparatus, comprising:

a channel for containing a flow of water, the channel having an inlet end connected to a water supply, a base, and spaced side walls;

a weir bed form in the base at the inlet end of the channel, and at least one additional bed form in the channel downstream of the weir bed form;

each bed form having a leading end, a trailing end, and an upper portion, at least the weir bed form having a downwardly inclined downstream face extending from the upper portion to the trailing end, the bed forms extending outwardly to the side walls and defining a primary water flow path from the inlet over the bed forms; and a raised spoiler forming an abrupt rise located downstream of the weir bed form and upstream of the leading end of the additional bed form;

the spoiler having a height in the range from about 5% to about 30% of the height of the upper portion of the bed form.

22. A method of forming waves, comprising:

directing water from a reservoir at one end of a channel having a base and spaced side walls into the channel and over a weir at the inlet end of the channel;

directing a stream of water flowing in the channel from the inlet end in a primary flow path over an extended horizontal tail portion following the weir and at least one bed form in the channel downstream of the horizontal tail portion, the bed form having a leading end and a trailing end, an upwardly inclined upstream face extending downstream of the leading end, and an upper portion, whereby at least one wave is formed in the water flowing along the channel; and controlling the flow rate of water supplied to the inlet end of the channel so as to vary the wave formation in the channel.

23. The method of claim 22, further comprising allowing at least part of the water stream above the height of the channel to flow outwardly onto side portions extending outward from the respective channel side walls along opposite sides of the channel and to drain downwardly to an exit end of the channel.

24. The method of claim 22, further comprising controlling the flow rate so that water flowing in the channel follows the shape of the bed form.

25. The method of claim 22, wherein the step of directing water from the reservoir over the weir comprises directing water from a wider portion of the reservoir through a reduced width inlet which connects the reservoir to the channel, whereby the width of the water flowing from the reservoir is reduced as it enters the channel and flows over the weir.

26. A wave generating apparatus, comprising:

a channel which contains a flow of water, the channel having an inlet end connected to a water supply, a base, spaced side walls, and an exit end;

a weir in the base at the inlet end of the channel, the weir having an upper portion and a downstream portion extending from the upper portion, the weir extending outwardly to the side walls to define a water flow path from the inlet end over the weir;

the downstream portion of the weir having a first, downwardly curved section extending from the upper portion and transitioning to a second, substantially horizontal tail portion;

a spoiler in the base of the channel downstream of the weir, the spoiler having an inclined leading face and an upper portion spaced above the base, whereby a wave is formed at the spoiler.

27. The apparatus of claim 26, wherein the spoiler is located at the exit end of the channel.

28. The apparatus of claim 26, further comprising an exit area at the end of the channel having a grating for draining water from the exit area, a chamber under the grating which collects water draining from the exit area, and a water recirculation passageway connecting the chamber to the inlet end of the channel.

29. A wave generating apparatus, comprising:

a channel which contains a flow of water, the channel having an inlet end connected to a water supply, a base, spaced side walls, and an exit end;

a weir in the base having an upper portion which is located at the inlet end of the channel and a downwardly inclined downstream portion which transitions to the base of the channel, whereby water from the water supply flows over the upper portion of the weir as it enters the channel; and a raised formation in the base of the channel spaced downstream from the weir, the raised formation having an upwardly extending leading face and an upper portion, whereby a wave is formed in water flowing over the raised formation.

30. The apparatus of claim 29, wherein the weir extends across the width of the channel.

31. The apparatus of claim 29, wherein the raised formation comprises a spoiler having a height less than the height of the weir.

32. The apparatus of claim 31, wherein the spoiler extends across the width of the channel.

33. The apparatus of claim 29, wherein the raised formation comprises a bed form having a height substantially equal to the height of the weir.

34. The apparatus of claim 29, further comprising a raised reservoir containing a supply of water located at the inlet end of the channel, the reservoir having a width greater than the width of the channel and having an outlet passageway of reduced width which supplies water from the reservoir directly onto the upper portion of the weir at the inlet end of the channel.

35. The apparatus of claim 34, wherein the width of the outlet passageway is substantially equal to the width of the inlet end of the channel, whereby water flowing from the reservoir into the channel is reduced in width as it enters the outlet passageway.

36. A method of forming waves, comprising the steps of:

directing water from at least one jet into a channel which has a base and spaced side walls for at least substantially containing a stream of water flowing from the jet along the channel;

directing the water stream flowing in the channel from the jet over at least one bed form in the channel downstream of the jet, the bed form having a leading end, an upwardly extending face, and an upper portion, such that at least one wave is formed in the water stream and at least part of the water stream at the wave is above the height of the channel;

allowing at least part of the water stream above the height of the channel to flow outwardly onto side portions extending outwardly from the respective side walls along opposite sides of the channel; and draining the water flowing outwardly onto the side portions downwardly along the side beaches.

* * * * *